US007641192B2

(12) United States Patent
Ouchi

(10) Patent No.: US 7,641,192 B2
(45) Date of Patent: Jan. 5, 2010

(54) SHEET FEEDER AND PROCESS OF FEEDING SHEET

(75) Inventor: Tetsuya Ouchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 77 days.

(21) Appl. No.: 11/862,958

(22) Filed: Sep. 27, 2007

(65) Prior Publication Data

US 2008/0079215 A1 Apr. 3, 2008

(30) Foreign Application Priority Data

Sep. 29, 2006 (JP) ..... 2006-269975

(51) Int. Cl.
*B65H 5/12* (2006.01)

(52) U.S. Cl. ..... 271/266; 271/270

(58) Field of Classification Search ..... 271/266, 271/270

See application file for complete search history.

(56) References Cited

U.S. PATENT DOCUMENTS

| | | | | |
|---|---|---|---|---|
| 4,607,572 | A * | 8/1986 | Pou et al. | 101/484 |
| 4,807,790 | A * | 2/1989 | Ushioda et al. | 226/2 |
| 5,050,858 | A * | 9/1991 | Nakamura | 271/265.01 |
| 5,149,080 | A * | 9/1992 | Yamamoto | 271/265.01 |
| 5,484,141 | A * | 1/1996 | Yamashita et al. | 271/227 |
| 5,597,154 | A * | 1/1997 | Yamashita | 271/10.05 |
| 5,602,571 | A * | 2/1997 | Suda et al. | 346/134 |
| 6,116,795 | A * | 9/2000 | Ogasawara | 400/582 |
| 6,257,692 | B1 * | 7/2001 | Yokoi et al. | 347/16 |
| 6,986,615 | B2 * | 1/2006 | Moore et al. | 400/625 |
| 7,415,239 | B2 * | 8/2008 | Saito et al. | 399/388 |
| 2005/0220524 | A1 * | 10/2005 | Ouchi | 400/76 |

(Continued)

FOREIGN PATENT DOCUMENTS

JP H08-119533 A 5/1996

(Continued)

OTHER PUBLICATIONS

Japanese Patent Office, Office Action, Notification of Reason for Refusal for Japanese Patent Application No. JP2006-269975, received Sep. 2, 2008 (counterpart of above-captioned U.S. patent application). (Partial Translation).

*Primary Examiner*—Patrick H Mackey
*Assistant Examiner*—Prasad V Gokhale
(74) *Attorney, Agent, or Firm*—Baker Botts, LLP

(57) ABSTRACT

A sheet feeder including: (a) a pair of feed rollers operable to have a plurality of successive rotational motions, so as to be rotated by a predetermined amount in each one of the successive rotational motions, for thereby causing a sheet nipped between the pair of feed rollers, to be fed along a feed path by a desired distance as a result of the each one of the successive rotational motions; (b) a back-tension applier disposed in the feed path, and configured to apply a back tension to the sheet that is fed along the feed path; and (c) a motion controller configured to control the successive rotational motions of the feed rollers, and to command the feed rollers to be rotated by a compensated amount that includes a supplementary amount in addition to the predetermined amount, in each of at least one of the successive rotational motions. Also disclosed is a process of feeding a sheet, by using the sheet feeder.

21 Claims, 18 Drawing Sheets

U.S. PATENT DOCUMENTS

| | | | | |
|---|---|---|---|---|
| 2006/0012105 | A1 | 1/2006 | Shiohara et al. | |
| 2007/0003352 | A1* | 1/2007 | Koga et al. | 400/582 |

FOREIGN PATENT DOCUMENTS

| | | | |
|---|---|---|---|
| JP | H08-231066 | A | 9/1996 |
| JP | H09-240088 | A | 9/1997 |
| JP | 2001-001584 | A | 1/2001 |
| JP | 2004-175092 | A | 6/2004 |
| JP | 2006-027826 | A | 2/2006 |
| JP | 2006-089252 | A | 4/2006 |
| JP | 2006-110779 | A | 4/2006 |
| JP | 2006-168286 | A | 6/2006 |

* cited by examiner

FIG.16

120

SUPPLEMENTARY-AMOUNT TABLE

| TYPE OF PAPER | RESOLUTION | AREA I | AREA II | AREA III |
|---|---|---|---|---|
| GLOSSY PAPER | 2400 | 1 | 2 | 3 |
| GLOSSY PAPER | 1200 | 4 | 4 | 4 |
| INKJET PAPER | 2400 | 1 | 2 | 2 |
| INKJET PAPER | 1200 | 2 | 3 | 3 |
| STANDARD PAPER | 1200 | 2 | 3 | 3 |
| STANDARD PAPER | 600 | 3 | 4 | 4 |

FIG.18

125

SUPPLEMENTARY-AMOUNT TABLE

| TYPE OF PAPER | RESOLUTION | AREA I | AREA II | AREA III |
|---|---|---|---|---|
| GLOSSY PAPER | 2400 | 0 | 1 | 0 |
| GLOSSY PAPER | 1200 | 0 | 1 | 0 |
| INKJET PAPER | 2400 | 0 | 0 | 0 |
| INKJET PAPER | 1200 | 0 | 0 | 0 |
| STANDARD PAPER | 1200 | 0 | 0 | 0 |
| STANDARD PAPER | 600 | 0 | 0 | 0 |

SHEET FEEDER AND PROCESS OF FEEDING SHEET

This application claims priority from Japanese Patent Application No. 2006-269975 filed on Sep. 29, 2006, the disclosure of which is herein incorporated by reference in its entirety.

BACKGROUND OF THE INVENTION

1. Field of the Invention

The present invention relates to a sheet feeder for feeding a sheet such as paper sheet (on which an image to be recorded or which has an image recorded thereon), and also a process of feeding the sheet in the sheet feeder.

2. Discussion of Related Art

On an image recording device such as printer and facsimile, there is installed a sheet feeder that is arranged to feed sheets accommodated in a sheet supply tray, along a feed path, as disclosed in JP-H08-119533A, for example.

In the conventional sheet feeder, in general, there are provided a sheet supply roller and a pair of sheet feed rollers. The sheet supply roller is disposed in an upstream portion of the feed path as viewed in a direction in which the sheet is to be fed along the feed path, and is configured to be held in pressing contact with an uppermost one of the sheets accommodated in the sheet supply tray. The sheet feed rollers are disposed in a downstream portion of the feed path, and consist of two rollers that are positioned on respective opposite sides of the feed path. Commonly, a DC motor is employed as a drive source for rotating the sheet supply roller and the sheet feed rollers.

As the DC motor as the drive source is driven, the sheet supply roller is rotated whereby the uppermost one of the sheets accommodated in the sheet supply tray is supplied toward the feed path. After a leading end of the sheet has reached a position of the sheet feed rollers, the sheet is nipped between the sheet feed rollers and is fed by the sheet feed rollers along the feed path. In this instance, the sheet feed rollers are intermittently driven or rotated, so as to feed the sheet in a sheet feed direction, with an amount of each intermittent feed movement of the sheet corresponding to an amount of line feed. In the image recording device incorporating therein such a sheet feeder, a recording head is moved in a main scanning direction (substantially perpendicular to the sheet feed direction) after each intermittent feed movement of the sheet, so that an image is recorded on the sheet that is thus fed by the amount of line feed in each intermittent feed movement thereof.

SUMMARY OF THE INVENTION

In the above-described sheet feeder, in general, not only a standard paper but also other type of papers such as glossy paper and inkjet paper are to be fed as the sheets, namely, various sheets having different thickness values and surface conditions are to be fed. It is common that the feed path (along which the sheet is to be fed) is curved to have a U-turn shape and that a feed path definer defining such a curved feed path is also curved. Therefore, when the sheet such as glossy paper is being fed along the curved feed path, for example, a friction is generated between the sheet and the feed path definer, and the generated friction constitutes a force (back tension) acting on the sheet in a direction that impedes the feed movement of the sheet. Further, the sheet supply roller is forced to be pressing contact with the sheet, until the sheet is separated from the sheet supply roller. The force of the pressing contact as well as the generated friction constitutes the back tension applied the sheet. The application of the back tension to the sheet is likely to cause slipping of the feed rollers relative to the sheet thereby resulting in shortage in an actual amount of the feed movement of the sheet. In other words, the sheet feeder could suffer from an undesirable phenomenon that the sheet cannot be fed in each intermittent feed movement by a required amount that corresponds to the amount of line feed.

Since the above-described shortage in the actual amount of the feed movement of the sheet cannot be detected by a sensor or the like, it is not possible to accurately compensate the shortage in the conventional sheet feeder. Where the sheet feeder is installed on the image recording device, the shortage could cause deterioration in quality of the image recorded on the sheet. Further, where the sheet feeder is installed on a scanner device so as to feed the sheet as an original which has an image recorded, the shortage could cause deterioration in quality of the image read out from the sheet.

The present invention was made in view of the background prior art discussed above. It is therefore an object of the invention to provide a sheet feeder and a sheet feeding process that make it possible to accurately compensate shortage in an actual amount of the feed movement of the sheet, which could be caused due to a back tension applied to the sheet. This object may be achieved according to a principle of the invention that is described below.

The principle of the invention provides a sheet feeder including: (a) a pair of feed rollers operable to have a plurality of successive rotational motions, so as to be rotated by a predetermined amount in each one of the successive rotational motions, for thereby causing a sheet nipped between the pair of feed rollers, to be fed along a feed path by a desired distance as a result of the each one of the successive rotational motions; (b) a back-tension applier disposed in the feed path, and configured to apply a back tension to the sheet that is fed along the feed path; and (c) a motion controller configured to control the successive rotational motions of the feed rollers, and to command the feed rollers to be rotated by a compensated amount that includes a supplementary amount in addition to the predetermined amount, in each of at least one of the successive rotational motions.

In the sheet feeder, the plurality of successive rotational motions are initiated, for example, when the sheet is supplied to the pair of feed rollers that may be disposed on opposite sides of the feed path. The feed rollers are rotated by the above-described predetermined amount in each one of the successive rotational motions, whereby the sheet nipped between the feed rollers is fed along the feed path by the desired distance as a result of each one of the successive rotational motions. The successive rotational motions, each causing the sheet to be fed or conveyed by the desired distance, are executed, for example, until the feed or convey movement of the sheet is completed. The back-tension applier is disposed in the feed path, so as to apply the back tension to the sheet that is fed along the feed path. The back tension applied to the sheet constitutes a force acting on the sheet in a direction that impedes the feed movement of the sheet. Therefore, the application of the back tension to the sheet could impede the sheet from being smoothly fed, and could cause a phenomenon that a distance by which the sheet is actually fed as a result of each one of the successive rotational motion is shorter than the desired distance. That is, due to disposition of the back-tension applied in the feed path, the sheet feeder could suffer from a problem that the sheet is not fed by the desired distance in each intermittent feed movement. It is noted that the back-tension applier may be constituted, for example, by a feed path definer that defines the feed path and a supply roller that is operable to supply the sheet toward the feed rollers. It is further noted that the above-described force constituted by the back tension applied to the sheet acts also as a load against rotation of the feed rollers in each one of the successive rotational motions. In this sense, the back-tension applied may be referred also to as a load applier.

The shortage in the actually feed distance of the sheet is not constantly caused during process of the feed movement of the sheet, because an amount of the back tension varies depending upon, for example, a positional relationship between the back-tension applier and the sheet. It is therefore considered that the shortage in the feed distance is caused in some of the successive rotational motions rather than in all of the successive rotational motions. In the sheet feeder according to the present invention, the motion controller is provided to compensate the shortage in the feed distance. Specifically, the feed rollers are commanded to be rotated by the compensated amount that includes the supplementary amount in addition to the predetermined amount (by which the feed rollers is to be rotated in each one of the successive rotational motions), in each of at least one of the successive rotational amounts. It is noted that the supplementary amount included in the compensated amount may be an amount that is predetermined based on various factors such as the amount of the back tension, type of the sheet and the above-described predetermined amount.

The principle of the invention provides also a process of feeding a sheet by using the above-described feeder, wherein the process includes: (i) a rotational-motion causing step of causing the pair of feed rollers to have each one of the plurality of successive rotational motions, so as to be rotated by the predetermined amount in the each one of the successive rotational motions, for thereby causing the nipped sheet to be fed along the feed path by the desired distance as a result of the each one of the successive rotational motions; and (ii) a controlling step of controlling the successive rotational motions of the feed rollers, and commanding the feed rollers to be rotated by the compensated amount that includes the supplementary amount in addition to the predetermined amount, in each of the at least one of the successive rotational motions.

In the sheet feeding process according to the invention, the rotational-motion causing step is implemented to cause the feed rollers to have each one of the successive rotational motions, so as to be rotated by the predetermined amount in each one of the successive rotational motions, for thereby causing the nipped sheet to be fed along the feed path by the desired distance as a result of each one of the successive rotational motions. As described above, the shortage in the feed distance is caused in at least one of the successive rotational motions. The controlling step is implemented to control the successive rotational motions of the feed rollers and to command the feed rollers to be rotated by the compensated amount that includes the supplementary amount in addition to the above-described predetermined amount, in each of at least one of the successive rotational motions.

In the sheet feeder and the sheet feeding process according to the invention, in which the feed rollers are commanded to be rotated by the compensated amount that includes the supplementary amount in addition to the predetermined amount, it is possible to accurately compensate the shortage in an actual amount of the feed movement of the sheet, with the supplementary amount being suitably determined or changed, based on various factors such as an estimated amount of the slipping of the feed rollers relative to the sheet and type of the sheet that is to be fed in the sheet feeder or sheet feeding process.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 16 is a supplementary-amount table 120 that is used in the first-motion controlling routine program of FIG. 15 and a second-motion controlling routine program of FIG. 17;

FIG. 18 is a supplementary-amount table 125 that is used in the second-motion controlling routine program of FIG. 17.

DETAILED DESCRIPTION OF THE PREFERRED EMBODIMENTS

There will be described an embodiment of the present invention, by reference to the accompanying drawings. It is noted that the embodiment will be described for illustrative purpose only and that the invention may be embodied with various changes, modifications and improvements, which may occur to those skilled in the art, without departing from the spirit of the invention defined in the appended claims.

Figure 1:
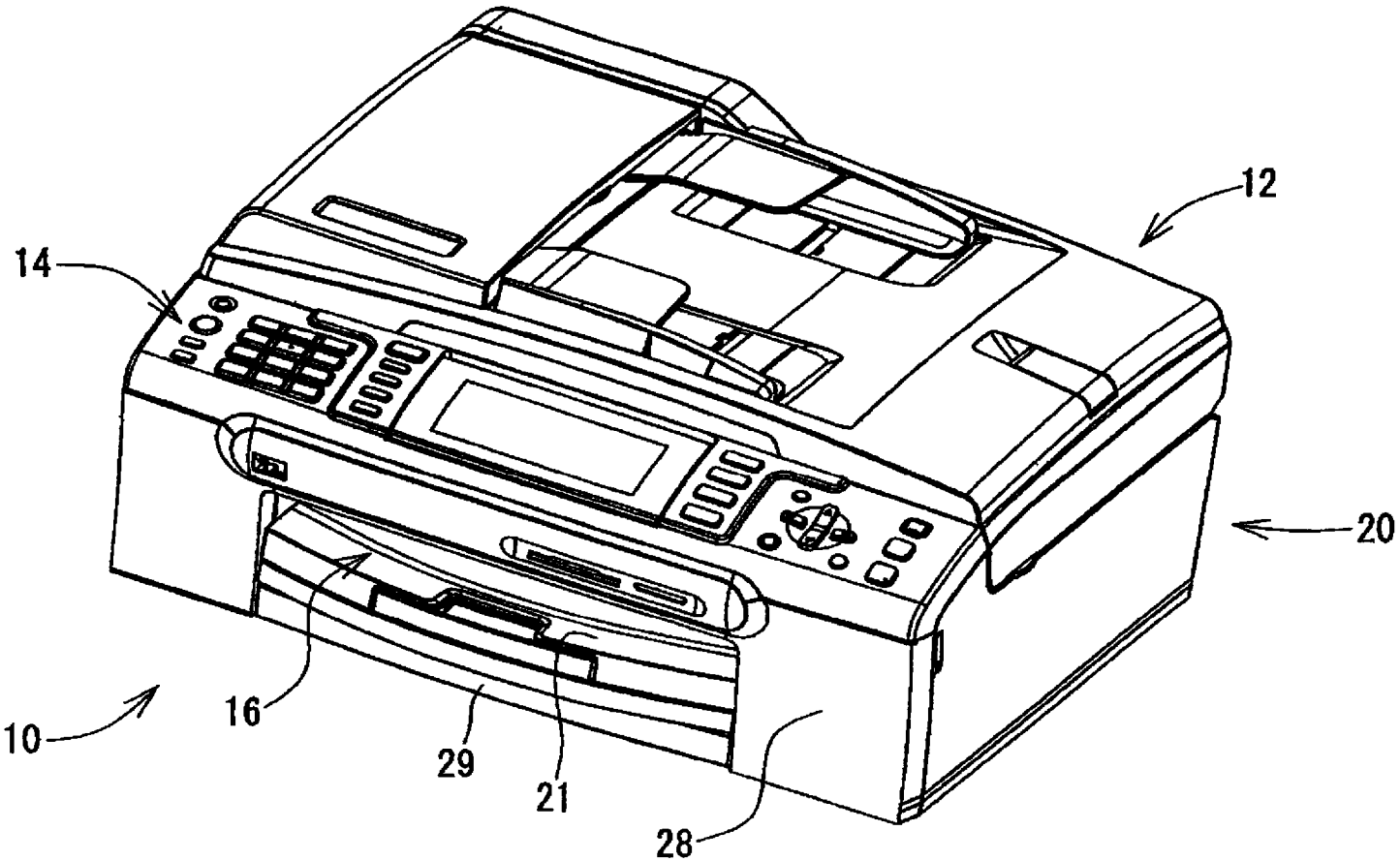
FIG. 1 is a perspective view of a multifunction device 10 incorporating therein a sheet feeder that is constructed according to an embodiment of the invention.

FIG. 1 is a perspective view of a multifunction device (multiplex device) 10 incorporating therein a sheet feeder that is constructed according to the present embodiment of the invention. As shown in FIG. 1, the multifunction device 10 includes a scanner unit 12 and a printer unit 20 that are generally provided by respective upper and lower portions of the device 10. The printer unit 20 is provided by an inkjet printer, and constitutes the sheet feeder that is arranged to convey or feed a recording sheet (as a sheet) from a sheet supply tray 29 to a sheet exit tray 21.

In the present embodiment, the sheet feeder is incorporated in the multifunction device 10 having printer, scanner, copier and facsimile functions. However, the sheet feeder may be incorporated in a single-function device having only the printer function without the scanner, copier and facsimile functions. Further, while the sheet feeder is constituted by the printer unit 20 in the present embodiment, the sheet feeder may be constituted by or incorporated in the scanner unit 12. That is, the sheet feeder may be provided, for example, by an automatic document feeder that is arranged to feed an original sheet (as a sheet) having an image or script recorded thereon that is to be read in the scanner unit 12.

During performance of the printer function, the multifunction device 10 is connected to an external data supplier such as computer (not shown), and the printer unit 20 is operated to record a desired image or script onto the recording sheet, based on data which is transmitted from the computer and which represents the desired image or script. Further, the multifunction device 10 may be connected also to an external device such as digital camera or a data storage medium such as memory card, so that the printer unit 20 can be operated to record a desired image onto the recording medium, based on data which is transmitted from the external device or the data storage medium and which represents the desired image.

As shown in FIG. 1, the multifunction device 10 has a generally rectangular parallelepiped shape, and its horizontal dimension (i.e., width and depth) is larger than its vertical dimension (i.e., height). The sheet supply tray 29 and the sheet exit tray 21 superposed on each other to constitute a double-deck tray assembly, which is introduced inside the printer unit 20 via an opening 16 that is provided in a front surface of the printer unit 20. In the sheet supply tray 29, there are accommodated recording sheets such as standard papers, glossy papers and inkjet papers. The size of each of the accommodated recording sheets is not particularly limited, as long as it is not larger than A4 size.

A door 28 is provided on a right side of the opening 16, and is openable so as to expose a cartridge mounted portion (not shown). Four ink cartridges can be mounted on the cartridge mounted portion, which faces a front side of the device 10 when the door 28 is open. The ink cartridges have respective main tanks storing respective four color inks, so that the main tanks are brought into communication with a recording head 39 (see FIG. 8) of an image recorder via respective ink tubes 41 (see FIG. 6) when the ink cartridges are mounted on the cartridge mounted portion. The recording head 39 is operable to perform a recording operation for recording an image or script on the recording sheets that are fed one after another by a pair of feed rollers in the form of a drive roller 67 and a driven (pinch) roller 64. In the present multifunction device 10, the four color inks are provided by cyan (C), magenta (M) and yellow (Y) inks as dye inks and a black (Bk) ink as a pigment ink, so that the cyan, magenta, yellow and black inks are supplied to the recording head 39 from the respective ink cartridges. It is noted that the number of color inks does not necessarily have to be four, but may be five, for example, so that the color inks are provided by a photo black (PBk) ink as a dye ink in addition to the above-described four color inks. It is further noted that sub-tanks together with the recording head 39 are disposed on a carriage 38 (see FIG. 6) so that the inks supplied from the ink cartridges are temporarily stored in the sub-tanks. The inks temporarily stored in the sub-tanks are eventually supplied to the recording head 39.

The scanner unit 12, which is provided by the upper portion of the multifunction device 10, is operated to read an image or script recorded on an original sheet. The scanner unit 12 has a flat bed scanner (FBS) and an automatic documents feeder (ADF). Since the sheet feeder constructed according to the invention is incorporated in the printer unit 20 in the present embodiment, a detail description of the scanner unit 12 is not provided herein.

An operator's control panel 14 is disposed on a front upper portion of the multifunction device 10, and has various keys and a liquid crystal display. The various keys are manually operable by an operator of the device 10 to input various command signals for various operations to be performed by the device 10. The liquid crystal display is provided for indicating a message and an image to provide the operator with information. The multifunction device 10 is operated in accordance with the command signals, which are inputted through the control panel 14 or which are transmitted from the external data supplier such as computer.

Figure 2:
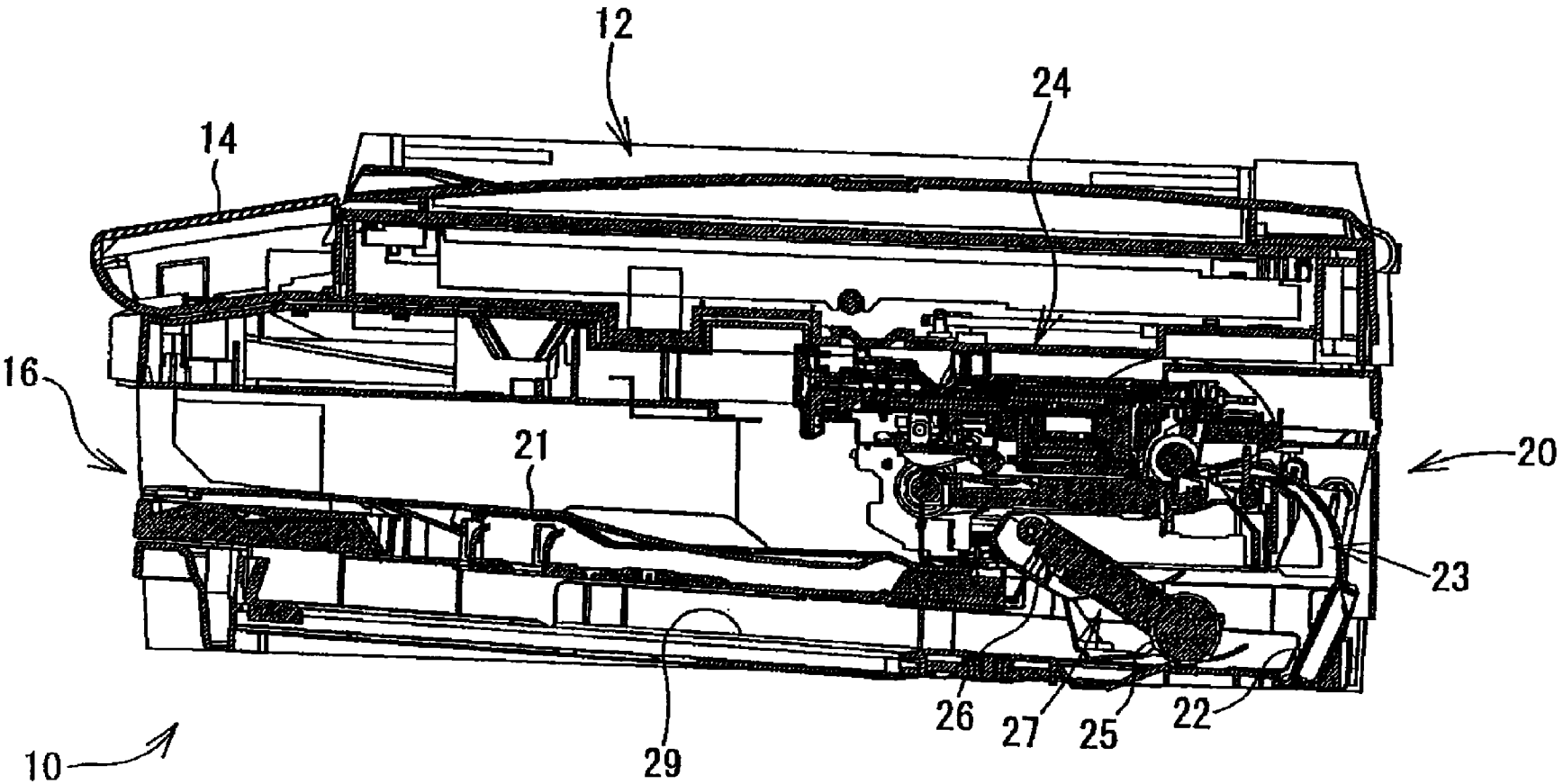
FIG. 2 is a side view in cross section showing an internal construction of the multifunction device 10 of FIG. 1.

As shown in FIG. 2, the sheet supply tray 29 is provided in a bottom portion of the multifunction device 10. On a rear side of the sheet supply tray 29, i.e., on a right side of the sheet supply tray 29 as seen in FIG. 2, there is disposed a slant sheet-separator plate 22 that is inclined rearwardly, i.e., rightwardly as seen in FIG. 2. This sheet-separator plate 22 serves to separate an uppermost one of the recording sheets accommodated in the sheet supply tray 29, from the other recording sheets, and to guide the uppermost recording sheet upwardly. Above the sheet-separator plate 22, a feed path definer 23 is provided to define a sheet feed path along which the sheets are to be fed one after another. The feed path definer 23 includes: a vertically extending portion extending upwardly from the sheet-separator plate 22; a horizontally extending portion extending through an image recorder 24 to the sheet exit tray 21; and a curved portion curved forwardly and interconnecting the vertically and horizontally extending portions. The recording sheets accommodated in the sheet supply tray 29 are guided by the feed path definer 23 including the curved portion, so as to make U turn and reach the image recorder 24 that faces an image recording portion of the sheet feed path. After having been subjected to an image recording operation performed by the image recorder 24, the recording sheets are discharged to the sheet exit tray 21. It is noted that the feed path definer 23 is constituted by outside guide surface and inside guide surface which are provided except in the above-described image recording portion of the sheet feed path and which are opposed to each other with a certain distance therebetween.

Figure 3:
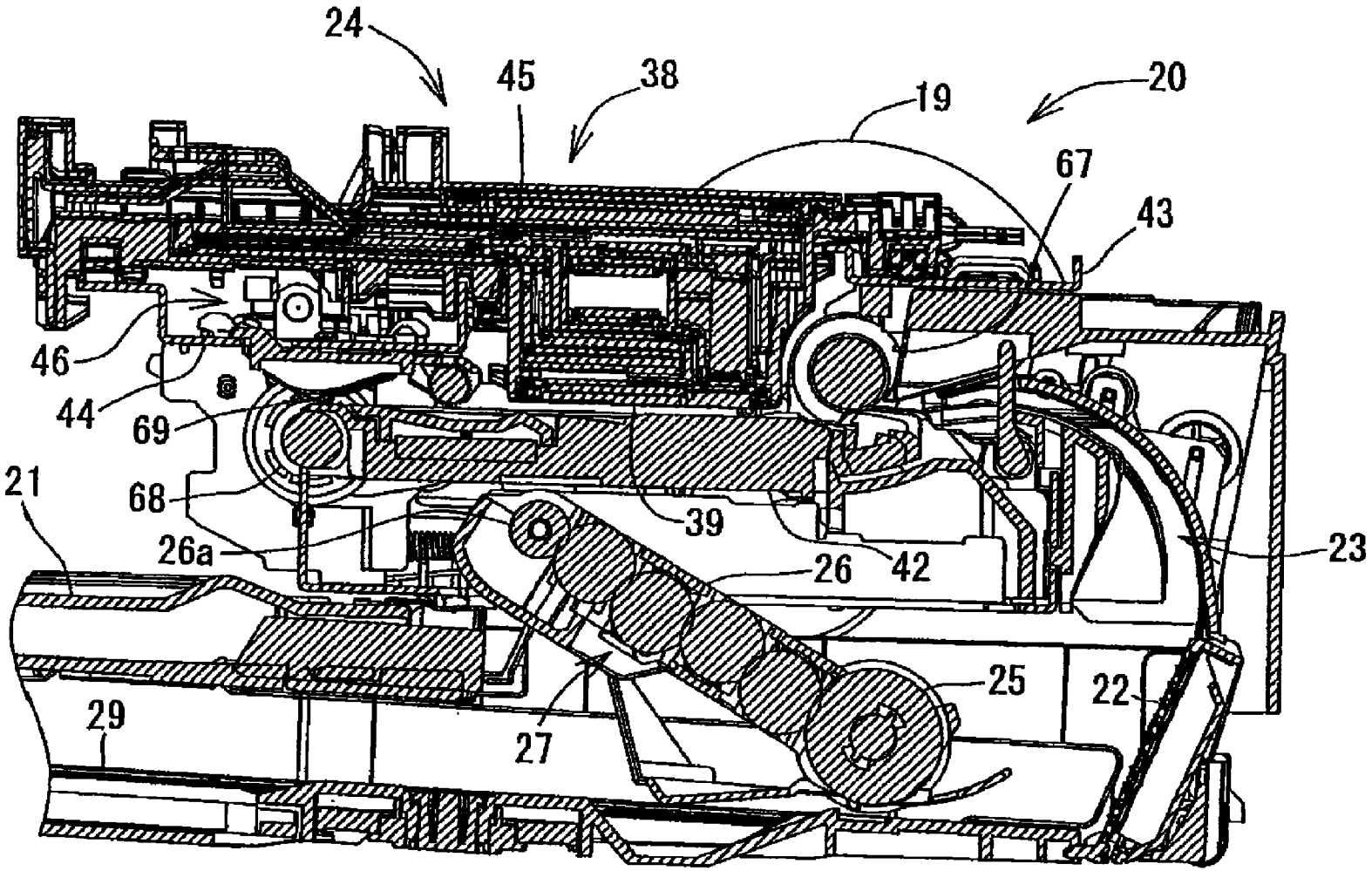
FIG. 3 is an enlarged view of a part of the side view of FIG. 2, showing a printer unit 20 as the sheet feeder incorporated in the multifunction device 10 of FIG. 1.

As shown in FIG. 3, above the sheet supply tray 29, there is disposed a sheet supply roller 25 that cooperates with the feed path definer 23 to constitute a back-tension applier. The sheet supply roller 25 is arranged to be held in pressing contact with the uppermost one of the recording sheets accommodated in the sheet supply tray 29, and is operable to supply the recording sheet toward the pair of feed rollers in the form of the above-described drive roller 67 (see FIGS. 3 and 10) and driven roller 64 (see FIG. 10). As shown in FIGS. 3 and 10, the sheet supply roller 25 is disposed on an upstream side of the feed path definer 23 in a sheet feed direction in which the recording sheet is to be fed along the sheet feed path. The sheet supply roller 25 is mounted on a shaft that is held by a distal end portion of a sheet supply arm 26. The sheet supply roller 25 is rotated by a drive force transmitted from a LF motor 85 (see FIG. 9) via a gear train 27, which is constituted by a plurality of gears meshing with each other and fixed to the sheet supply arm 26.

As shown in FIG. 3, the sheet supply arm 26 is held at its proximal end portion by a pivot shaft 26*a*, so as to be pivotable about the pivot shaft 26*a*. With pivot motion of the sheet supply arm 26, the sheet supply roller 25 (held by the distal end portion of the sheet supply arm 26) is vertically moved toward and away from the sheet supply tray 29. Since the sheet supply arm 26 is pivoted due to its own weight in clockwise direction as seen in FIG. 3, the sheet supply roller 25 is brought into pressing contact with the uppermost one of the recording sheets accommodated in the sheet supply tray 29. When the sheet supply tray 29 and the sheet exit tray 21 are introduced inside the printer unit 20 or extracted from the printer unit 20 via the opening 16 (see FIG. 2), the sheet supply arm 26 is pivoted in counterclockwise direction as seen in FIG. 3 whereby the sheet supply roller 25 is moved upwardly away from the sheet supply tray 29. The sheet supply roller 25 is rotated by the drive force transmitted from the LF motor 85, while being held in pressing contact with the uppermost one of the recording sheets accommodated in the sheet supply tray 29, whereby the uppermost recording sheet is moved toward the slant sheet-separator plate 22 by a friction acting between a roller surface of the supply roller 25 and a surface of the uppermost recording sheet. The recording sheet is moved upwardly to the feed path definer 23, after being brought into contact at its leading end with the slant sheet-separator plate 22. Upon movement of the uppermost recording sheet by the sheet supply roller 25, there is a case where other recording sheet or sheets (located below the uppermost recording sheet) are moved, for example, due to fiction or electrostatic effect. However, in such a case, the other recording sheet or sheets are inhibited from being further moved, due to their contact with the slant sheet-separator plate 22.

As shown in FIG. 3, the drive roller 67 is disposed on a downstream side of the feed path definer 23 that includes the curved portion, in the sheet feed direction (in which the recording sheet is to be fed along the sheet feed path). As shown in FIG. 10, the driven roller 64 (that is not shown in FIG. 3) is disposed on one of opposite sides of the sheet feed path that is remote from the drive roller 67. The driven roller 64 is biased to be held in pressing contact with the drive roller 67. The recording sheet, which has been guided by the feed path definer 23, enters between the drive and driven rollers 67, 64. Thus, the recording sheets accommodated in the sheet supply tray 29 are supplied by the sheet supply roller 25, one after another, toward the drive and driven rollers 67, 64. Upon entrance of the recording sheet between the drive and driven rollers 67, 64, the driven roller 64 is moved away from the drive roller 67 by a distance corresponding to a thickness of the recording sheet, so as to cooperate with the drive roller 67 to pinch the recording sheet. The drive roller 67 is rotated by the drive force that is transmitted from the LF motor 85 (see FIG. 9), and a rotational force is reliably transmitted to the recording sheet, whereby the recording sheet is moved over a platen 42 (see FIG. 3). As shown in FIG. 3, an encoder disk 19 of a rotary encoder 83 (see FIG. 9) is coaxially fixed to the drive roller 67, so as to be rotatable together with the drive roller 67, so that the rotation of the drive roller 67 can be detected by detecting the rotation of the encoder disk 19.

During at least a part of the feed movement of each recording sheet, the drive and driven rollers 67, 64 are given successive first (standard) and/or second (fine) successive rotational motions. The drive and driven rollers 67, 64 are rotated by a predetermined amount in each one of the first successive rotational motions, for thereby causing the recording sheet P nipped between the rollers 67, 64, to be fed along the sheet feed path by a desired distance as a result of each one of the first successive rotational motions. In the present embodiment, the first successive rotational motions are initiated when the leading end of the recording sheet P reaches between the drive and driven rollers 67, 64. After the leading end of the recording sheet reaches between the rollers 67, 64, the drive roller 67 is controlled by a controller unit 100 to be rotated intermittently by the above-described predetermined amount in each one of the first successive rotational motions. In the present embodiment, the above-described desired distance, by which the recording sheet P is to be fed as a result of the predetermined amount of rotation of the drive and driven rollers 67, 64, corresponds to a so-called amount of line feed. That is, during a recording operation performed for recording an image or script onto the sheet P, the recording head 39 (see FIG. 10) is moved in a main scanning direction (i.e., direction perpendicular to drawing sheet of FIG. 10) while being operated to eject ink droplets onto the sheet P, after each one of the first successive rotational motions of the rollers 67, 64 that causes the sheet P nipped between the rollers 67, 64 to be fed by the desired distance that corresponds to the amount of line feed. Thus, the movement of the recording head 39 with ejection of the ink droplets and the feed movement of the sheet P by the desired distance are alternately repeated whereby the image or script is continuously formed on an entirety of the sheet P.

Figure 12:
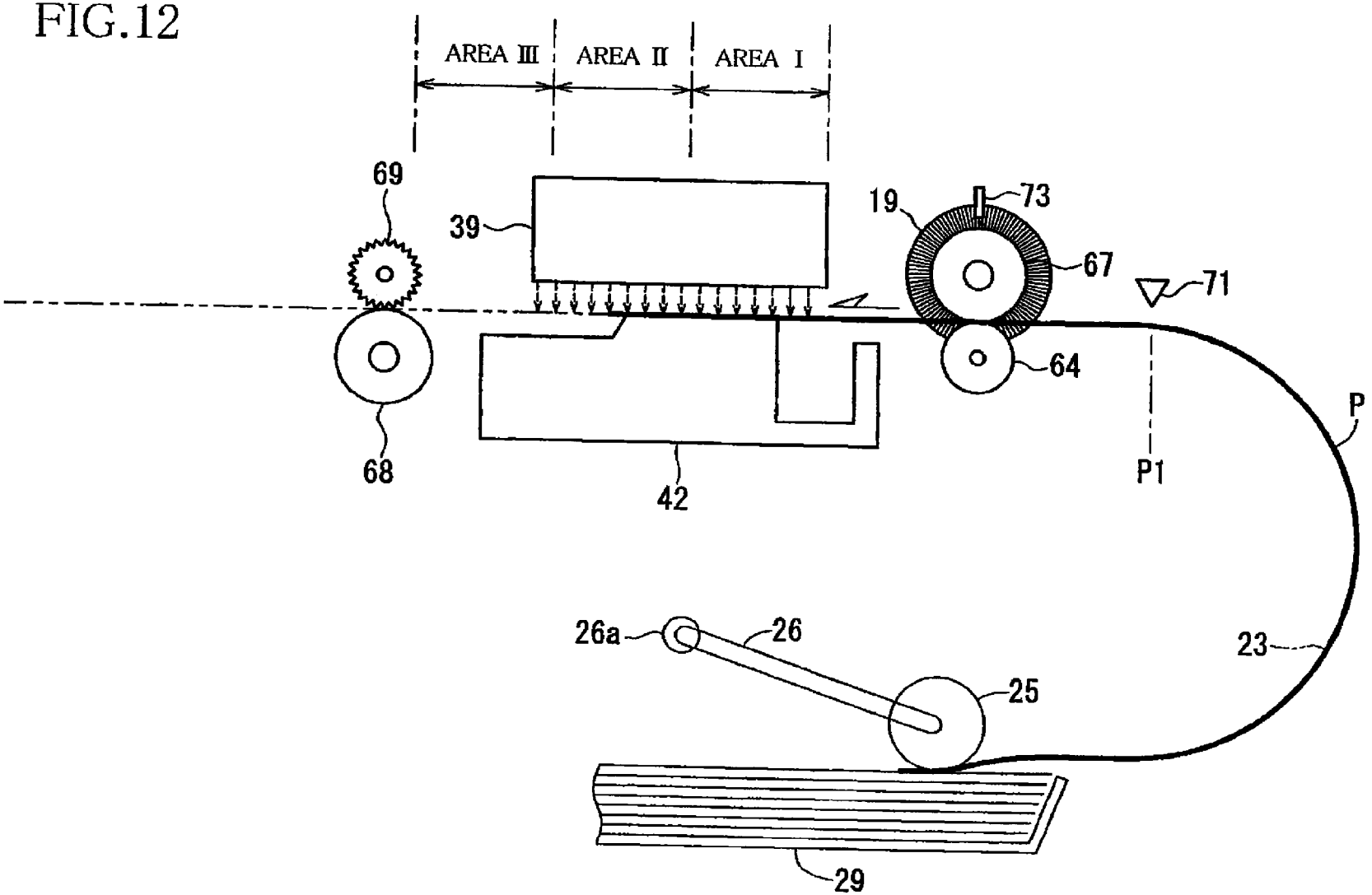
FIG. 12 is a view schematically showing a state in which the leading end of the recording sheet P is located within area II of the U-turn-shaped feed path.

The drive and driven rollers 67, 64 are rotated by a divided amount in each one of the second successive rotational motions, for thereby causing the sheet P nipped between the rollers 67, 64, to be fed along the sheet feed path by a divided distance. The divided amount is an amount into which the above-described predetermined amount is divided by a predetermined number "n" (e.g., n=2). The divided distance is represented by "N/n", where "N" represents the above-described desired distance and "n" represents the predetermined number. In the present embodiment, the second successive rotational motions are given to the rollers 67, 64 at a stage as shown in FIG. 12, at which the leading end of the sheet P is located in area II. That is, at the stage of the area II, each of the first successive rotational motions is made by the predetermined number "n" of the second successive rotational motions, so that the recording head 39 is moved in the main scanning direction while being operated to eject ink droplets on the sheet P, after each of the predetermined number "n" of the second successive rotational motions that causes the nipped sheet P to be fed by the desired distance "N" that corresponds to the amount of line feed.

As shown in FIG. 3, the image recorder 24 is disposed on a downstream side of the drive roller 67 in the sheet feed direction. The image recorder 24 is equipped with the carriage 38 (see FIG. 6) that is reciprocatable in the main scanning direction (i.e., direction perpendicular to drawing sheet of FIG. 10) that is substantially perpendicular to the sheet feed direction. To the recording head 39 carried by the carriage 38, the above-described four color inks, i.e., cyan (C), magenta (M), yellow (Y) and black (Bk) inks are supplied from the respective ink cartridges via the respective ink tubes 41 (see FIG. 6). The recording head 39 is operable to selectively eject the color inks in the form of ink droplets. During movement of the recording sheet P on the platen 42 by the drive and driven rollers 67, 64, the recording head 39 is operated to selectively eject the ink droplets toward the recording sheet P while being reciprocated in the main scanning direction, whereby an image or script is recorded on the sheet P that is moved on the platen 42. It is noted that the desired distance "N" and the divided distance "N/n" are determined depending upon the amount of line feed in the recording operation performed by the recording head 39. The amount of line feed is changed depending upon a desired resolution of the image recorded by the recording head 39. The desired distance "N" and the divided distance "N/n" are changed with change in the amount of line feed.

A discharge roller 68 is disposed on a downstream side of the image recorder 24 in the sheet feed direction. Spur wheels 69 are provided on one of opposite sides of the sheet feed path that is remote from the discharge roller 68, and are held in pressing contact with the discharge roller 68. As the recording sheet P (that is subjected to the recording operation performed by the image recorder 24 while being moved on the platen 42) enters between the discharge roller 68 and the spur wheels 69, the sheet P is nipped between the discharge roller 68 and the spur wheels 69. The drive force generated by the LF motor 85 (see FIG. 9) is transmitted to the discharge roller 68 as well as to the drive roller 67, whereby the discharge roller 68 as well as the drive roller 67 is intermittently rotated by the above-described predetermined amount. It is noted that the discharge roller 68 is rotated in synchronization with rotation of the drive roller 67.

Figure 4:
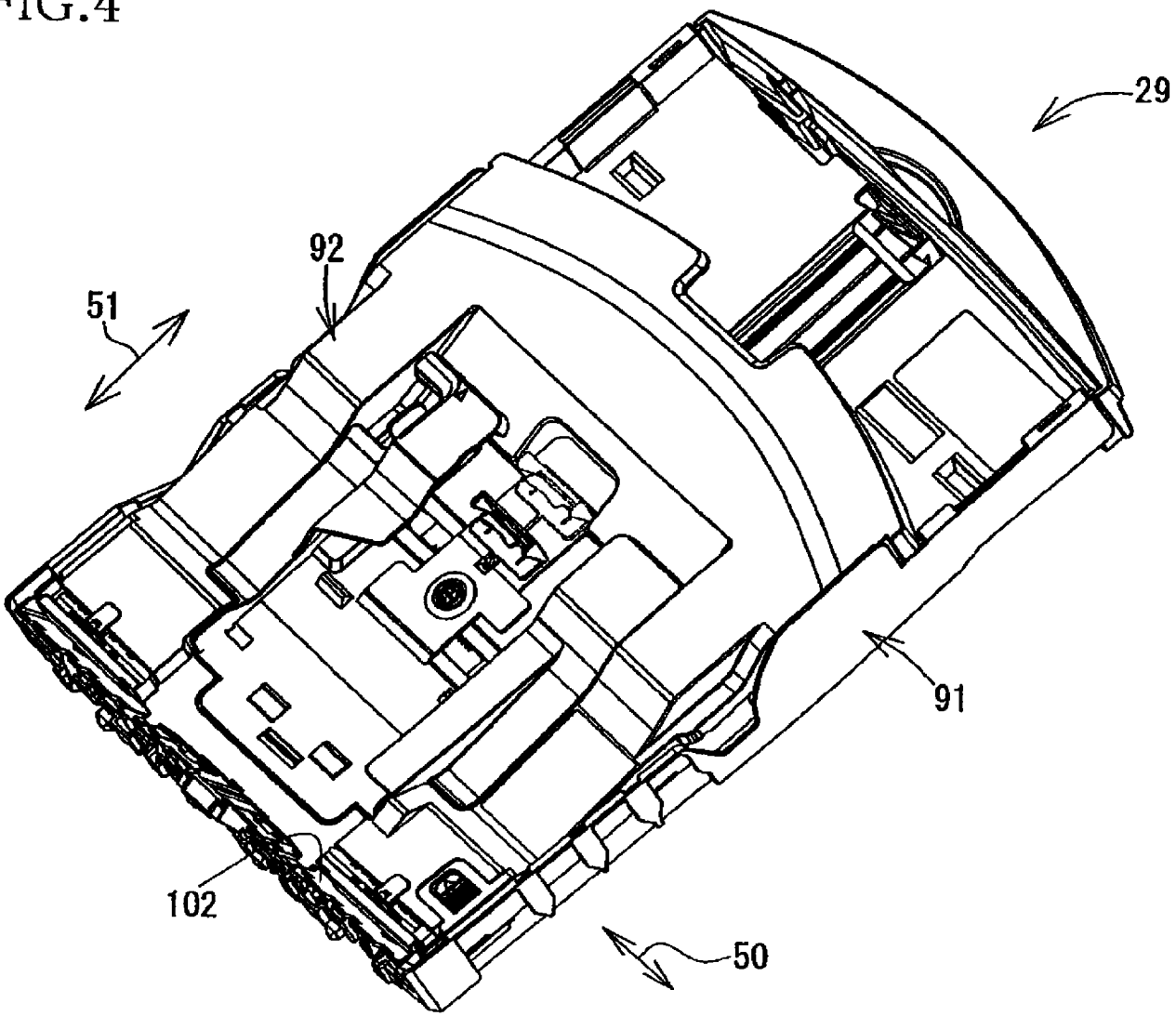
FIG. 4 is a perspective view of a sheet supply tray 29 including a first tray portion 91 and a second tray portion 92 that is pivotable relative to the first tray portion 91, when the second tray portion 92 is placed in its stacked position.
Figure 5:
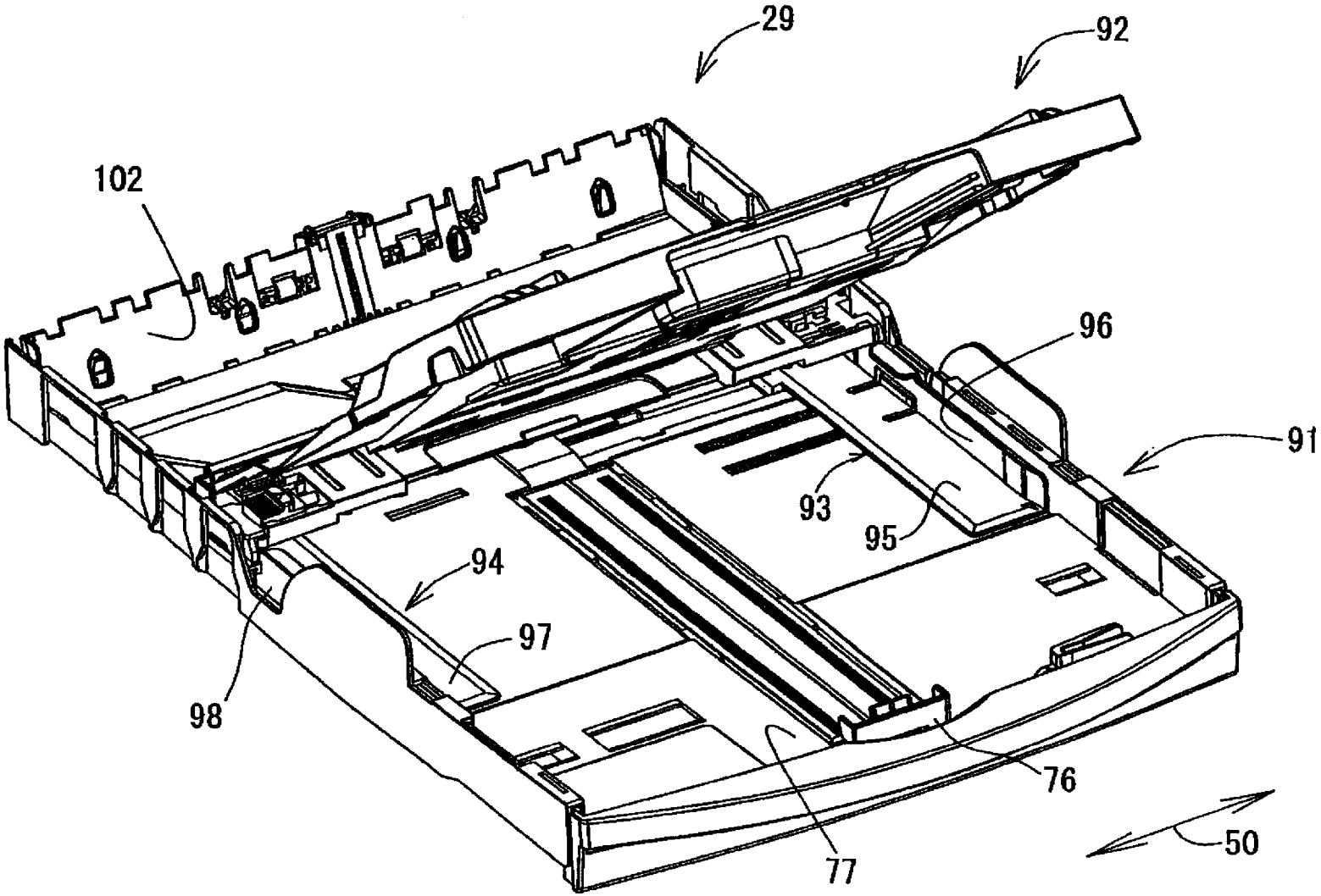
FIG. 5 is a perspective view of the sheet supply tray 29 of the printer unit 20 when the second tray portion 92 is placed in its opening position.

As shown in FIG. 4, the sheet supply tray 29 has a rectangular parallelepiped shape as a whole, and its horizontal dimension (i.e., width and depth) is larger than its vertical dimension (i.e., height). The sheet supply tray 29 is constituted by a first tray portion 91 and a second tray portion 92 that is superposed on the first tray portion 91. The second tray portion 92 is pivotable relative to the first tray portion 91, such that a posture of the second tray portion 92 is changeable between a stacked position (as shown in FIG. 4) and an opening position (as shown in FIG. 5). When the second tray portion 92 is placed in the stacked position, the second tray portion 92 is stacked on the first tray portion 91. When the second tray portion 92 is placed in the opening position, the second tray portion 92 opens the first tray portion 91.

The first tray portion 91 is provided to accommodate therein standard papers whose size is not larger than A4 size. The second tray portion 92 is provided to accommodate therein non-standard papers such as L-sized glossy papers and inkjet papers. Thus, the sheet supply tray 29 is capable of concurrently accommodating therein two types of recording sheets. It is noted that the types of recording sheets to be accommodated in the first and second tray portions 91, 92 are not particularly limited. For example, the non-standard papers may be accommodated in the first tray portion 91 while the standard papers may be accommodated in the second tray portion 92.

As shown in FIG. 5, the first tray portion 91 is provided with a pair of lateral guide members 93, 94 that are slidable toward and away from each other in directions parallel to the width of the multifunction device 10, i.e., in directions indicated by arrows 50. The guide member 93 is constituted by a horizontal plate portion 95 that is horizontally disposed within the first tray portion 91 and a vertical plate portion 96 that vertically extends from the horizontal plate portion 95. Similarly, the guide member 94 is constituted by a horizontal plate portion 97 that is horizontally disposed within the first tray portion 91 and a vertical plate portion 98 that vertically extends from the horizontal plate portion 97. The recording sheets P are held by the first tray portion 91, with the sheets P being disposed on the horizontal plate portions 95, 97 and being held in contact at their lateral ends with the lateral plate portions 96, 98. The lateral guide members 93, 94 are slid or moved symmetrically with respect to a center of the first tray portion 91 in the width direction of the device 10. Thus, a widthwise center of each recording sheet P accommodated in the first tray portion 91 always coincides with the widthwise center of the first tray portion 91, irrespective of size of the accommodated sheet P.

The first tray portion 91 is further provided with a slide plate member 76 which extends vertically from a bottom wall 77 of the first tray portion 91 and which is slidable or movable in directions parallel to the depth of the multifunction device 10, i.e., in directions indicated by arrows 51 (see FIG. 4). The slide plate member 76 is slid to be brought into contact with rear ends of the sheets P accommodated in the first tray portion 91. Thus, the accommodated sheets P are positioned in a predetermine position in the sheet feed direction and a lateral direction that is perpendicular to the sheet feed direction, thereby making it possible to prevent each sheet P from being inclined with respect to the sheet feed direction when the sheet P leaves the first tray portion 91.

The second tray portion 92 is slidable relative to the first tray portion 91 in the directions parallel to the depth of the device 10, i.e., in the directions indicated by the arrows 51 (see FIG. 4). FIG. 4 shows a state in which the second tray portion 92 is positioned in a rear end portion of the first tray portion 91. Another state in which the second tray portion 92 is positioned in a front end portion of the first tray portion 91 is not shown in the drawings. When the second tray portion 92 is slid from the front end portion of the first tray portion 91 to the rear end portion of the first tray portion 91, the sheet supply roller 25 is forced upwardly whereby the sheet supply arm 26 is pivoted in a direction indicated by arrow 18 (see FIG. 10), so that the sheet supply roller 25 is brought into contact with an uppermost one of the recording sheets P accommodated in the second tray portion 92. Therefore, with the LF motor 85 (see FIG. 9) being driven, the sheets P accommodated in the second tray portion 92 are supplied, one after another, toward the feed path definer 23. On the other hand, when the second tray portion 92 is slid from the rear end portion of the first tray portion 91 to the front end portion of the first tray portion 91, the sheet supply roller 25 is no longer forced by the second tray portion 92 whereby the sheet supply arm 26 is pivoted in a direction opposite to the direction indicated by the arrow 18 (see FIG. 10), so that the sheet supply roller 25 is brought into contact with an uppermost one of the recording sheets P accommodated in the first tray portion 91. Therefore, with the LF motor 85 being driven, the sheets P accommodated in the first tray portion 91 are supplied, one after another, toward the feed path definer 23.

Figure 6:
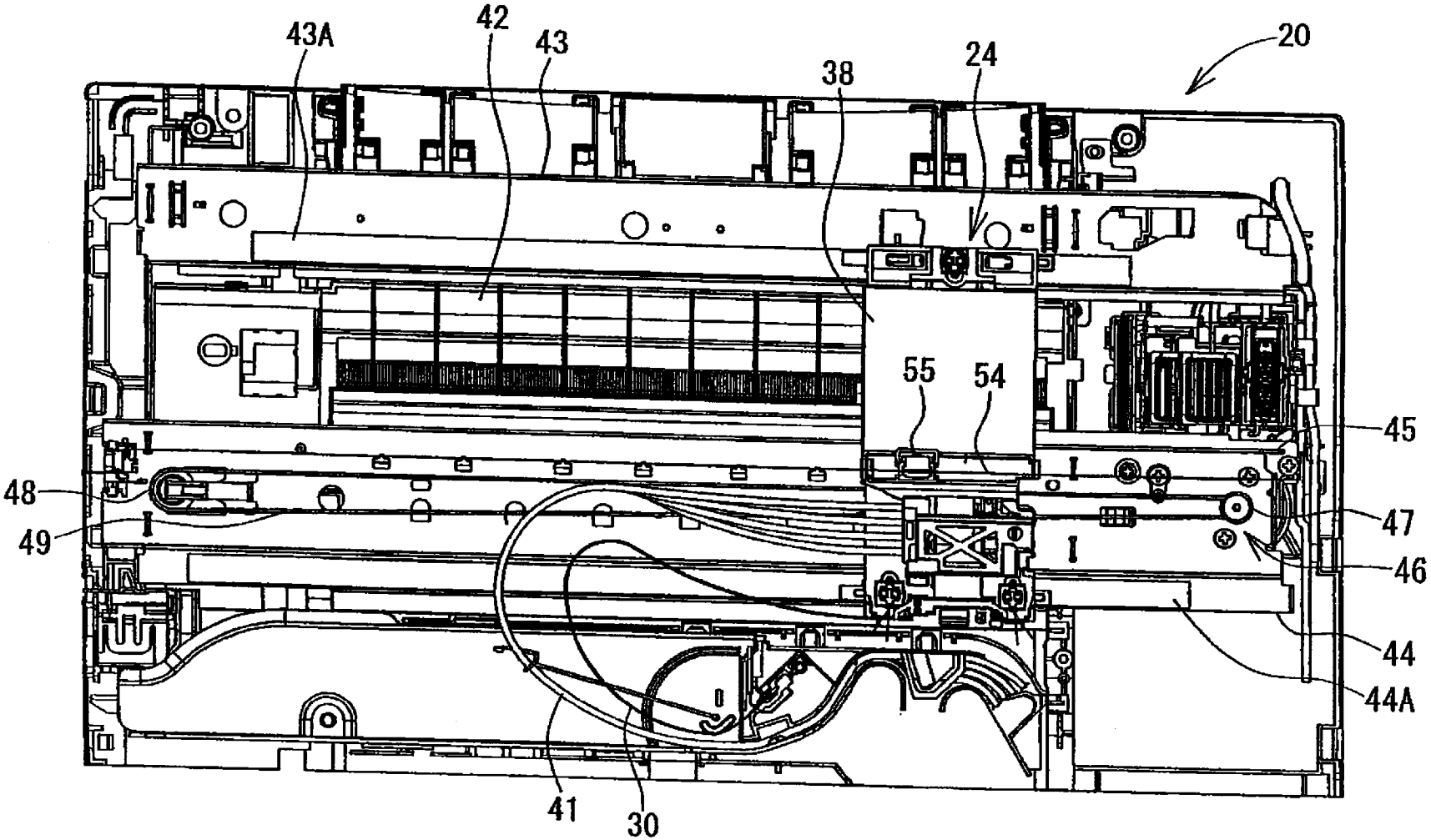
FIG. 6 is a plan view showing a main construction of the printer unit 20.

As shown in FIG. 6 that is a plan view showing a main construction of the printer unit 20, a pair of guide rails 43, 44 are disposed on an upper side of the platen 42. The guide rails 43, 44 are spaced apart from each other in the sheet feed direction (in which the sheets P are to be fed), i.e., in a vertical direction as seen in FIG. 6, and extend in a direction perpendicular to the sheet feed direction, i.e., in right and left directions as seen in FIG. 6. The carriage 38 is arranged to straddle the guide rails 43, 44 so as to be slidable on the guide rails 43, 44. Thus, the carriage 38 is reciprocatable in a horizontal direction perpendicular to the sheet feed direction.

The guide rail 43, which is an upstream one of the guide rails 43, 44 in the sheet feed direction, is provided by a plate-like member having a length (as measured in a width direction of the sheet feed path) that is larger than a distance within which the carriage 38 is reciprocatable. The carriage 38 is slidably held at its upstream end portion by a guide surface 43A that is provided by an upper surface of a downstream end portion of the guide rail 43.

The guide rail 44, which is a downstream one of the guide rails 43, 44 in the sheet feed direction, is provided by another plate-like member having substantially the same length of the guide rail 43. The carriage 38 is slidably held at its downstream end portion by a guide surface 44A that is provided by an upper surface of a downstream end portion of the guide rail 44. An upstream end portion 45 of the guide rail 44 is bent by substantially a right angle so as to upwardly extend. The upstream end portion 45 of the guide rail 44 is gripped between a pair of rollers (not shown) of the carriage 38. The carriage 38 is slidably held by the guide rails 43, 44 and is reciprocatable in the width direction of the sheet feed path, with the upstream end portion 45 of the guide rail 44 serving as a reference portion.

A belt drive mechanism 46 is disposed on an upper surface of the guide rail 44. The belt drive mechanism 46 includes a drive pulley 47, a driven pulley 48 and an endless timing belt 49. The drive and driven pulleys 47, 48 are disposed in respective widthwise opposite end portions of the sheet feed. The timing belt 49 has teeth formed in its inside surface, and is wound on the drive and driven pulleys 47, 48, with a predetermined degree of tension being given to the timing belt 49. The drive pulley 47 has teeth formed in its outer circumferential surface. Since the teeth of the drive pulley 47 mesh with the teeth of the timing belt 49, a rotational motion of the drive pulley 47 is reliably transmitted to the timing belt 49 whereby the timing belt 49 is circulated. The carriage 38 is fixed to a portion of the timing belt 49 so that the carriage 38 is movable on the guide rails 43, 44 by the circulating motion of the timing belt 49. The recording head 39 carried by the carriage 38 is reciprocatable together with the carriage 38 in the main scanning direction, i.e., in the width direction of the sheet feed path.

The drive pulley 47 is disposed on an end portion of the upper surface of the guide rail 44 (i.e., right end portion of the upper surface of the guide rail 44 as seen in FIG. 6), and is rotatable about an axis that extends in a vertical direction perpendicular to the guide surface 44A. Although not shown in FIG. 6, a CR (carriage) motor 80 (see FIG. 9) is disposed on a lower side of the guide rail 44. The CR motor 80 generates a drive force that is transmitted to a drive shaft of the drive pulley 47 whereby the carriage 38 is moved by rotation of the drive pulley 47.

An encoder strip 54 (see FIG. 6) is disposed along the upstream end portion 45 of the guide rail 44. The encoder strip 54 cooperates with a photointerrupter 55 (see FIG. 6) that is provided in the carriage 38 and arranged to detect the encoder strip 54), to constitute a linear encoder 84 (see FIG. 9). The reciprocating movement of the carriage 38 is controlled based on a detection signal supplied by the linear encoder 84.

As shown in FIG. 6, the platen 42 is disposed in a position which is located on a lower side of the sheet feed path and which is opposed to the recording head 39 in the vertical direction. The recording sheet P passes over a central region of a stroke range of the carriage 38. The platen 42 is arranged to extend over the central range. It is noted that the platen 42 has a width sufficiently larger than a width of a maximum-sized recording sheet that can be used in the present multi-function device 10 so that widthwise opposite ends of the recording sheet P pass over the platen 42 while the recording sheet P is being fed along the sheet feed path. The platen 42 is held in parallel to the guide rails 43, 44, with a predetermined spacing distance between the platen 42 and the guide rails 43, 44, so that a predetermined amount of gap is maintained between two mutually opposed surfaces, i.e., an upper surface of the platen 42 and a lower surface of the recording head 39 that are opposed to each other.

To the recording head 39, the color inks are supplied via the respective ink tubes 41 (see FIG. 6) from ink cartridges (not shown) that are provided to store therein the respective color inks. That is, the different color inks are supplied to the recording head 39 from the respective ink cartridges that are independent from each other, via the respective ink tubes 41 that are also independent from each other. Each ink tube 41 is formed of a synthetic resin and has a flexibility to be bent so as to follow the reciprocating movement of the carriage 38.

Figure 7:
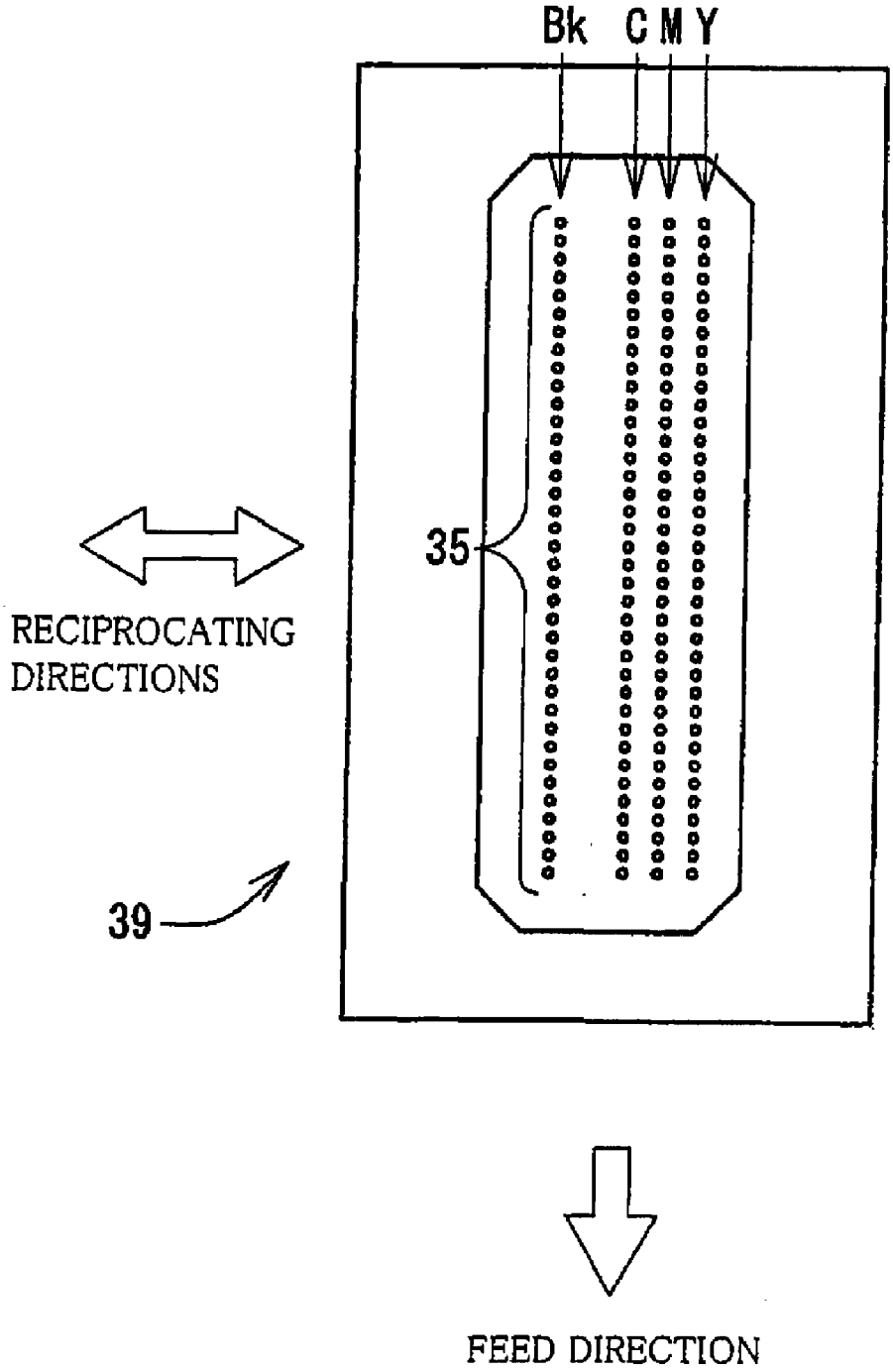
FIG. 7 is a bottom view showing a nozzle opening surface of a recording head 39 of the printer unit 20.

FIG. 7 shows a bottom surface of the recording head 39 as a nozzle opening surface. As shown in FIG. 7, a plurality of nozzles 35 opening in the nozzle opening surface are arranged in four rows. The four rows extend in the sheet feed direction, and are arranged in a direction parallel to carriage reciprocating directions in which the carriage 38 is reciprocatable. The nozzles 35 of each one of the four rows are assigned to eject a corresponding one of the four color inks, i.e., cyan (C), magenta (M), yellow (Y) and black (Bk) inks. The pitch of the nozzles 35 as measured in the sheet feed direction and the number of the nozzles 35 as counted in the sheet feed direction are suitably determined, for example, in view of a desired resolution of the recorded image. Further, the number of the rows of the nozzles 35 may be changed depending upon, for example, types of the inks and the number of colors.

Figure 8:
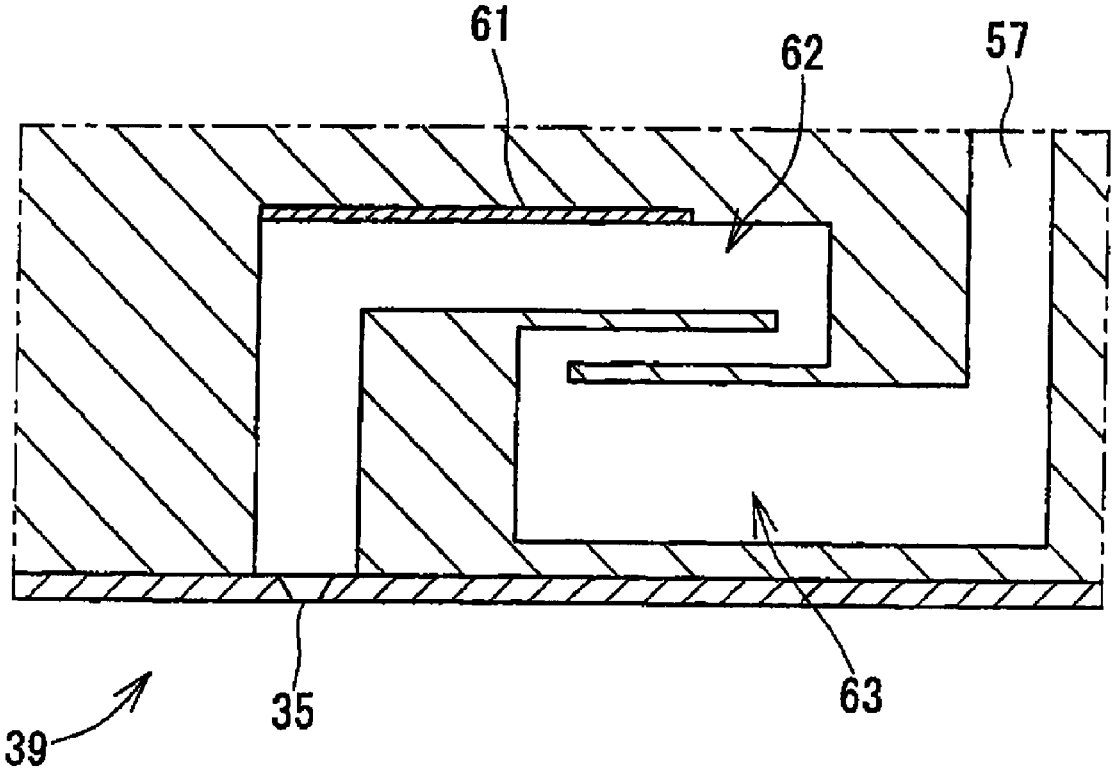
FIG. 8 is a cross sectional view schematically showing an internal construction of a part of the recording head 39 of the printer unit 20.

FIG. 8 is a cross sectional view schematically showing an internal construction of a part of the recording head 39 which defines cavities 62, manifold chambers 63 and ink inlets 57 in addition to the above-described nozzles 35. As shown in FIG. 8, on an upstream side of each of the nozzles 35 opening in the lower surface of the recording head 39, there is defined a corresponding one of the cavities 62. Each piezoelectric element 61, which is provided to face the corresponding cavity 62, is deformed when a predetermined amount of voltage is applied thereto from a head control circuit board 33 (see FIG. 9). The deformation of the piezoelectric element 61 causes reduction in volume of the corresponding cavity 62 whereby the ink stored in the corresponding cavity 62 is ejected as ink droplets through a corresponding one of the nozzles 35 (that is held in communication with the corresponding cavity 62).

The cavities 62 are held in communication with the respective nozzles 35. Each pair of the cavity 62 and nozzle 35, which are held in communication with each other, belongs to one of groups that is assigned for a corresponding one of the cyan (C), magenta (M), yellow (Y) and black (Bk) inks. Each of the manifold chambers 63 is provided for storing a corresponding one of the four color inks, and is held in communication with the cavities 62 and nozzles 35 that belong to the corresponding group. Each manifold chamber 63 is held in communication with a corresponding one of the above-described sub-tanks (that stores the corresponding color ink), via a corresponding one of the ink inlets 57 that is defined in an upstream side of the manifold chamber 63, so that the ink stored in the sub-tank is supplied to the manifold chamber 63 via the ink inlet 57. The supplied ink is distributed by the manifold chamber 63 into the cavities 62 that are held in communication with the manifold chamber 63. The ink distributed to each cavity 62 is ejected as ink droplets through the corresponding nozzle 35, by deformation of the corresponding piezoelectric element 61. The thus constructed recording head 39 is operated to eject the inks onto the recording sheet fed along the feed path definer 23 during reciprocating movement of the carriage 38.

Figure 9:
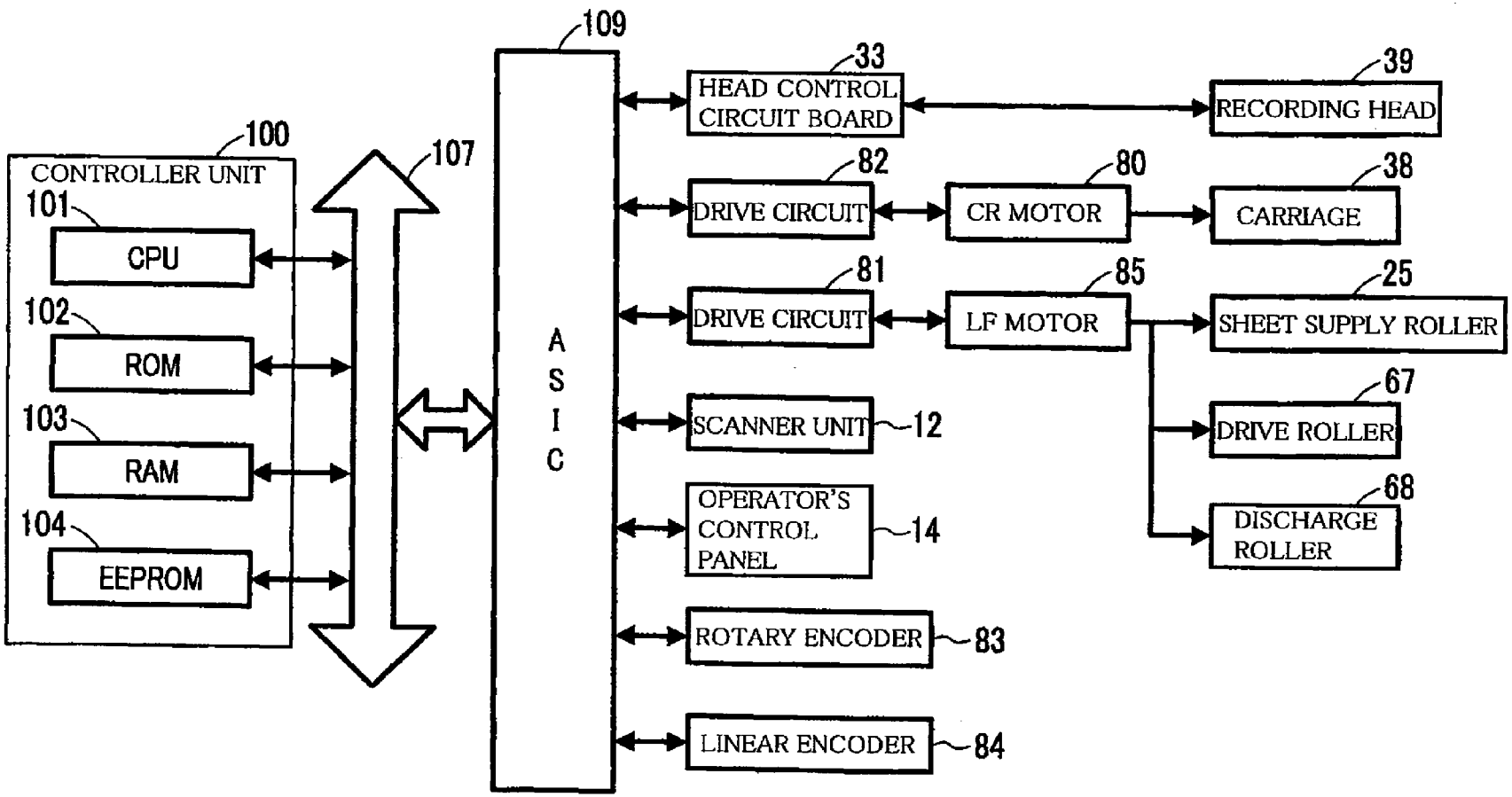
FIG. 9 is a block diagram showing a construction of a controller unit 100 of the multifunction device 10, by way of example.
Figure 10:
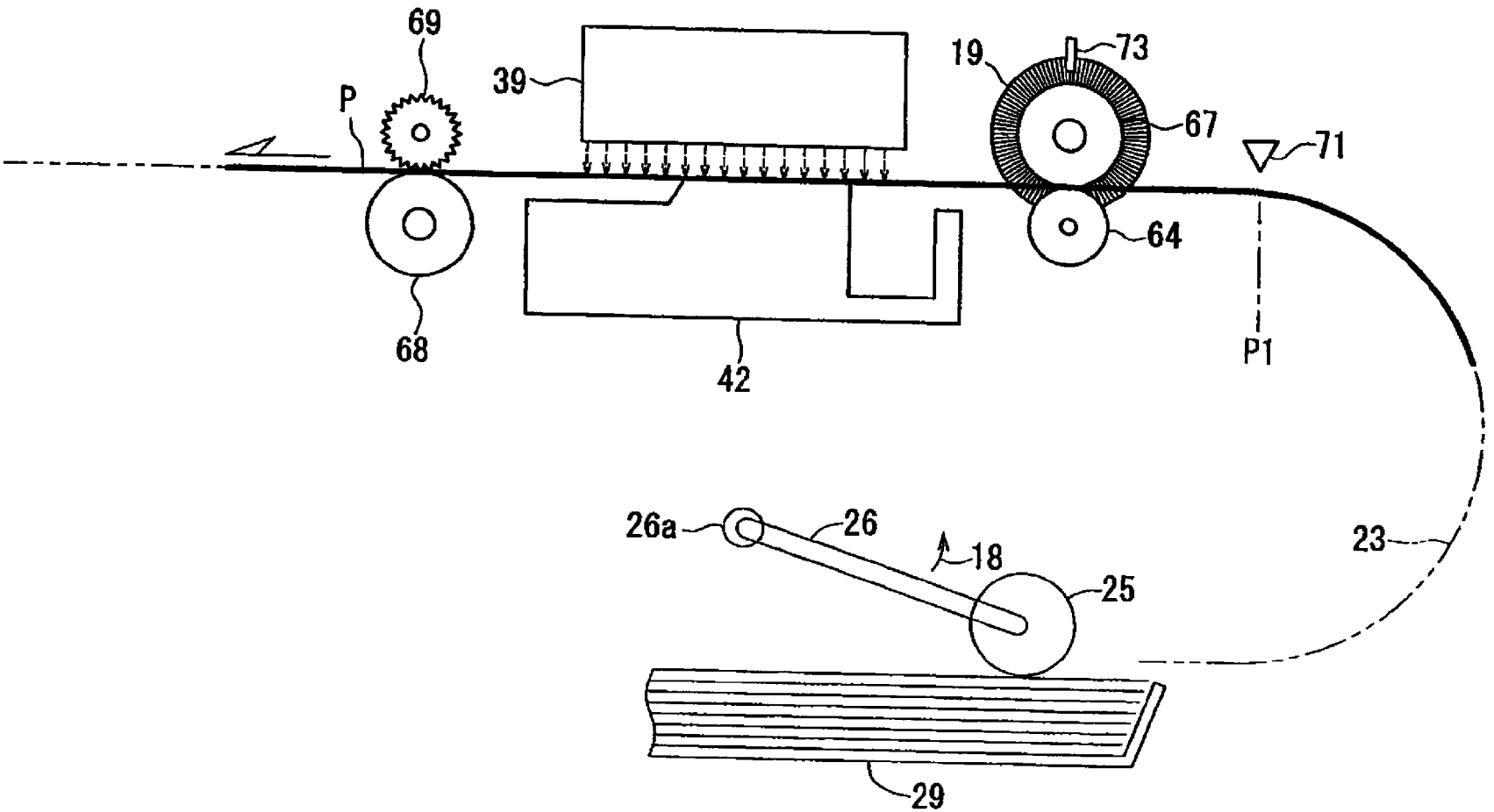
FIG. 10 is a view schematically showing a U-turn-shaped feed path defined by a feed path definer 23.

FIG. 9 is a block diagram showing a construction of the controller unit 100, which is provided to control all operations performed in the multifunction device 10. The controller unit 100 includes a motion controller, a first determiner, a second determiner, a first shortage-distance estimator and a second shortage-distance estimator. As shown in FIG. 9, the controller unit 100 is provided by a microcomputer that is constituted principally by a CPU (Central Processing Unit) 101, a ROM (Read Only Memory) 102, a RAM (Random Access Memory) 103 and a EEPROM (Electrically Erasable and Programmable ROM) 104. The controller unit 100 is connected to an ASIC (Application Specific Integrated Circuit) 109 via a bus 69.

The ROM 102 stores therein, for example, programs for controlling various operations of the multifunction device 10. In the present embodiment, the ROM 102 stores therein also supplementary-amount tables 120, 125 (see FIGS. 16 and 18) that will be described below. Meanwhile, the RAM 103 is used as a working or storage area for temporarily storing various data, based on which the programs are executed by the CPU 101. In the present embodiment, the RAM 103 stores therein a feed distance and a shortage distance of the recoding sheet P that are estimated by the rotary encoder 83 serving as first and second feed distance estimators and first and second shortage distance estimators. The EEPROM 104 keeps storing therein, even after power OFF of the device 10, data relating to determinations and flags that are to be held.

To the ASIC 109, there are connected the head control circuit board 33, drive circuits 81, 82, scanner unit 12 (see FIG. 1), operator's control panel 14 (see FIG. 1), rotary encoder 83 and linear encoder 84.

The ASIC 109 supplies, to the head control circuit board 33, data signal indicative of image that is to be recorded on the recording sheet P. The head control circuit board 33 controls operation of the recording head 39, based on the data signal supplied from the ASIC 109, so that the inks are selectively ejected through the nozzles 35 (see FIG. 8) at predetermined timing whereby the image is recorded on the recording sheet P. It is noted that the head control circuit board 33 as well as the recording head 39 is carried by the carriage 38 (see FIG. 6).

The drive circuit 82 supplies drive signal to the CR motor 80, namely, energizes the CR motor 80, based on, for example, phase energization signal supplied from the ASIC 109. The CR motor 80 is driven upon reception of the drive signal, whereby the reciprocating movement of the carriage 38 (see FIG. 6) is controlled.

The drive circuit 81 is provided to drive the LF motor 85 which is arranged to rotate the sheet supply roller 25, drive roller 67 and discharge roller 68 (see FIG. 3). The drive circuit 81 drives the LF motor 85 upon reception of output signal from the ASIC 109. The drive force of the LF motor 85 is selectively transmitted to the sheet supply roller 25, drive roller 67 and discharge roller 68 via a known transmission mechanism that includes gears and drive shafts.

The scanner unit 12 is operated to read an image or script recorded on an original sheet. The operator's control panel 14 has the various keys manually operable by an operator of the device 10 to input various command signals, and the liquid crystal display provided for indicating a message and an image to provide the operator with information.

The rotary encoder 83, serving as the first and second feed distance estimators and the first and second shortage distance estimators, is configured to estimate an actual position of the recording sheet P or a distance by which the sheet P is actually fed, by measuring an actual angular position or an actual amount of rotation of the drive roller 67. Specifically, the rotary encoder 83 measures an actual amount of rotation of the drive roller 67 in each one of the first successive rotational motions, for estimating a distance by which the sheet P is actually fed as a result of the each one of the first successive rotational motions, so as to serve as the first feed distance estimator. Further, the rotary encoder 83 measures an actual amount of rotation of the drive roller 67 in each one of the second successive rotational motions, for estimating a distance by which the sheet P is actually fed as a result of the each one of the second successive rotational motions, so as to serve as the second feed distance estimator. The controller unit 100 controls the feed movement of the sheet P, i.e., the LF motor 85 (see FIG. 9) arranged to rotate the drive roller 67, based on result of the measurement or estimation made by the rotary encoder 83. The linear encoder 84 is configured to detect an amount of movement of the carriage 38, so that the controller unit 100 controls the reciprocating movement of the carriage 38, based on result of the detection made by the linear encoder 84.

To the ASIC 109, there are connected a slot, a parallel interface and a USB interface. The slot is provided to receive various types of small-sized memory cards inserted thereinto. The parallel interface and the USB interface are provided to enable data communication with an external device such as a personal computer, via a parallel cable and a USB cable.

FIG. 10 is a view schematically showing the U-turn-shaped feed path defined by the feed path definer 23. As shown in FIG. 10, a register sensor 71 is disposed in an upstream side of the pair of feed rollers, i.e., the drive and driven rollers 67, 64, in the sheet feed direction. The register sensor 71 is configured to detect presence of the recording sheet P that is fed along the sheet feed path. The register sensor 71, which is provided by a mechanical sensor in the present embodiment, includes a reflection type optical sensor (photointerrupter) and a feeler that is held by a pivotable shaft. The photointerrupter includes a light emitter for emitting light toward the feeler and a light receiver for receiving the light reflected by the feeler. The register sensor 71 outputs a sensor signal based on brightness of the light received by the light receiver of the photointerrupter (e.g., an electric signal based on the brightness). When the feeler is in a position opposed to the photointerrupter, the light reflected by the feeler is received by the light receiver of the photointerrupter. In this instance, the register sensor 71 outputs the sensor signal based on the brightness of the light received by the light receiver, and is placed in its ON state since the feeler is detected.

The feeler is pivoted by contact of the recording sheet P with the feeler, which is caused when the sheet P reaches a position P1 (see FIG. 10). As a result of pivot movement of the feeler, the posture of the feeler is changed such that the feeler is not opposed to the photointerrupter. In this instance, the light emitted from the light emitter toward the feeler is not reflected from the feeler toward the light receiver, namely, the light emitted by the light emitter is not received by the light receiver, so that an electric current is not outputted by the light receiver, whereby the register sensor 71 is placed in its OFF state. Thus, the operational state of the register sensor 71 is changed depending upon whether the recording sheet P reaches the position P1 or not, thereby enabling the controller unit 100 to detect the presence of the sheet P, based on the sensor signal outputted by the register sensor 71.

As shown in FIG. 10, an optical sensor 73 is disposed in proximity of the encoder disk 19, which is attached to a drive shaft of the drive roller 67 so as to be rotatable together with the drive roller 67. The encoder disk 19 is provided by a transparent disk member having marks that are arranged in a radial manner at a predetermined amount of angular pitch along a circle. The rotary encoder 83 detects rotation of the encoder disk 19, by counting the number of the marks of the encoder disk 19, based on result of the detection made by the optical sensor 73. Since the drive roller 67 is rotated together with the encoder disk 19, the rotation of the drive roller 67 can be detected by detecting the rotation of the encoder disk 19. The optical sensor 73 is arranged to output one pulse signal upon detection of each one of the marks of the encoder disk 19. The rotary encoder 83 detects the rotation of the drive roller 67, namely, measures an actual amount of the rotation of the drive roller 67, by counting the number of outputted pulse signals (hereinafter referred to as "encoder amount" where appropriate). For example, the encoder amount will be 50 where a total of 50 marks of the encoder disk 19 are detected by the optical sensor 73.

There will be next described a process of feeding the recording sheet P. The controller unit 100 controls in a manner that causes the sheet P to be supplied from the sheet supply tray 29 to the drive roller 67. Specifically described, the controller unit 100 drives the LF motor 85 so as to rotate the sheet supply roller 25 that is held in pressing contact with an uppermost one of the sheets P accommodated in the sheet supply tray 29. Thus, with the rotation of the sheet supply roller 25, the uppermost sheet P is forced toward the slant sheet-separator plate 22 (see FIG. 3), and is guided by the slant sheet-separator plate 22 toward the feed path definer 23. Thus, the recording sheet P is supplied from the sheet supply tray 29 to the feed path definer 23.

The above-described register sensor 71 is disposed in the position P1 (see FIG. 10) in the sheet feed path defined by the feed path definer 23. The register sensor 71 is held in the ON state before the recording sheet P reaches the position P1. When the sheet P reaches the position P1, the register sensor 71 is placed from the ON state to the OFF state. Therefore, the controller unit 100 can determine whether the sheet P has reached the position P1, by monitoring change of the sensor signal outputted by the register sensor 71. When determining that the sheet P has reached the position P1, based on the sensor signal outputted by the register sensor 71, the controller unit 100 starts to count the number of steps of the LF motor 85 that rotates the sheet supply roller 25. Then, the controller unit 100 determines that the leading end of the sheet P reaches between the drive and driven rollers 67, 64, when the counted number of the steps of the LF motor 85 reaches a predetermined number. In this instance, the drive roller 67 is rotated by the drive force transmitted from the LF motor 85, in counterclockwise direction as seen in FIG. 10, i.e., in a direction that is opposite to a direction that cause the sheet P to be fed in the sheet feed direction.

The controller unit 100 counts a predetermined length of time after the leading end of the recording sheet P reaches between the drive and driven rollers 67, 64. Then, after having counted the predetermine length of time, the controller unit 100 controls the LF motor 85 such that the drive roller 67 is rotated in clockwise direction as seen in FIG. 10, i.e., in the direction that causes the sheet P to be fed in the sheet feed direction. While the predetermined length of time is being counted, the sheet P is deflected with the leading end being held in contact with an outer circumferential surface of the drive roller 67, whereby inclination of the sheet P is corrected. After the counting of the predetermine length of time, the sheet P is nipped by the drive and driven rollers 67, 64, and is moved on the platen 42 by the rotation of the drive roller 67 in the clockwise direction.

The drive and driven rollers 67, 64 are given the first successive rotational motions, so as to be rotated by the predetermined amount in each one of the first successive rotational motions, for thereby causing the nipped sheet P to be fed along the sheet feed path by the desired distance as a result of each one of the first successive rotational motions. That is, with the first rotational motion being repeated, the sheet P is fed intermittently along the sheet feed path that is defined by the feed path definer 23. The desired distance, by which the sheet P is to be fed as a result of each one of the first successive rotational motions, corresponds to the amount of line feed in a recording operation in which an image or script is continuously recorded onto the sheet P by the recording head 39. That is, the sheet P nipped by the drive and driven rollers 67, 64 is moved below the recording head 39 by the amount of line feed in each one of the first successive rotational motions. Thus, during the recording operation performed for recording an image or script onto the sheet P, the recording head 39 is commanded by the controller unit 100 to be moved in the main scanning direction while ejecting ink droplets onto the sheet P, after each one of the first successive rotational motions of the rollers 67, 64. Thus, the movement of the recording head 39 with ejection of the ink droplets and the feed movement of the sheet P by the desired distance are alternately repeated whereby the image or script is continuously formed on an entirety of the sheet P. It is noted that the recording operation does not have be performed according to a particular method, but may be performed according to any methods such as interlacing method.

As described above, the first rotational motion is a motion of each of the drive and driven rollers 67, 64 for causing the recording sheet P nipped between the rollers 67, 64 to be fed along the sheet feed path by the above-described desired distance, and is repeated until the feed or convey movement of the sheet P is completed. In the sheet feed path, there is provided a back-tension applier that is configured to apply a back tension to the sheet P. The back-tension applier is provided by the feed path definer 23 and the sheet supply roller 25. The term "back tension" is interpreted to mean a force acting on the sheet P in a direction that impedes the feed movement of the sheet P.

The recording sheet P nipped between the drive and driven rollers 67, 64 is fed by the first successive rotational motions of the rollers 67, 64, along the sheet feed path defined by the feed path definer 23. Since the feed path definer 23 as well as the sheet feed path per se includes the curved portion so as to have a U-turn shape as a whole, a friction is generated between a wall of the feed path definer 23 and a surface of the sheet P (that is in contact with the wall of the feed path definer 23), as the sheet P is fed by the drive and driven rollers 67, 64. The friction, which is dependent upon a coating disposed on the surface of the sheet P and a rigidity of the sheet P, acts as the back tension that impedes the feed movement of the sheet P. Particularly, where the recording sheet P is provided by an inkjet paper or a glossy paper, the back tension applied from the feed path definer 23 to the sheet P is larger than where the sheet P is provided by a standard paper. Further, since the sheet supply roller 25 is held in pressing contact with the sheet P until the sheet P is separated from the sheet supply roller 25, the sheet supply roller 25 applies the back tension to the sheet P at a stage, for example, at which the drive force is not transmitted to the sheet supply roller 25 for a while after the sheet P starts to be moved by the drive and driven rollers 67, 64.

Thus, during the feed movement of the recording sheet P, the recording sheet P receives a force which is applied from the feed path definer 23 and the sheet supply roller 25 and which acts in the direction that impedes the feed movement of the sheet P. Consequently, the sheet P is impeded from being smoothly fed, and causes a phenomenon that a distance by which the sheet P is actually fed as a result of each one of the first successive rotational motion is shorter than the above-described desired distance. That is, the provision of the feed path definer 23 and the sheet supply roller 23 serving as the back-tension applier causes slipping of the drive and driven rollers 67, 64 relative to the sheet P, thereby resulting in shortage in an actual amount of the feed movement of the sheet P.

Figure 11:
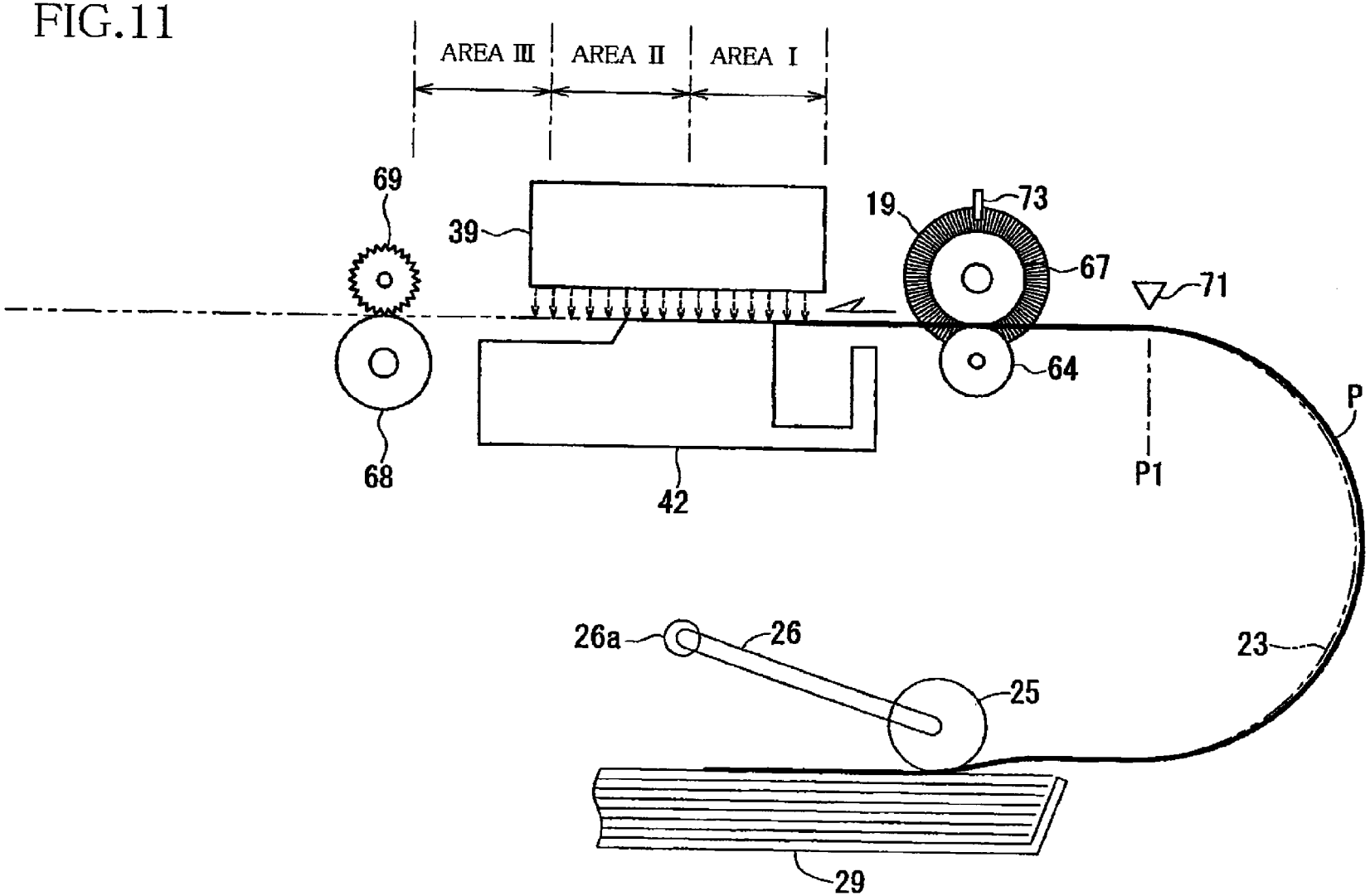
FIG. 11 is a view schematically showing a state in which a leading end of a recording sheet P is located within area I of the U-turn-shaped feed path.
Figure 13:
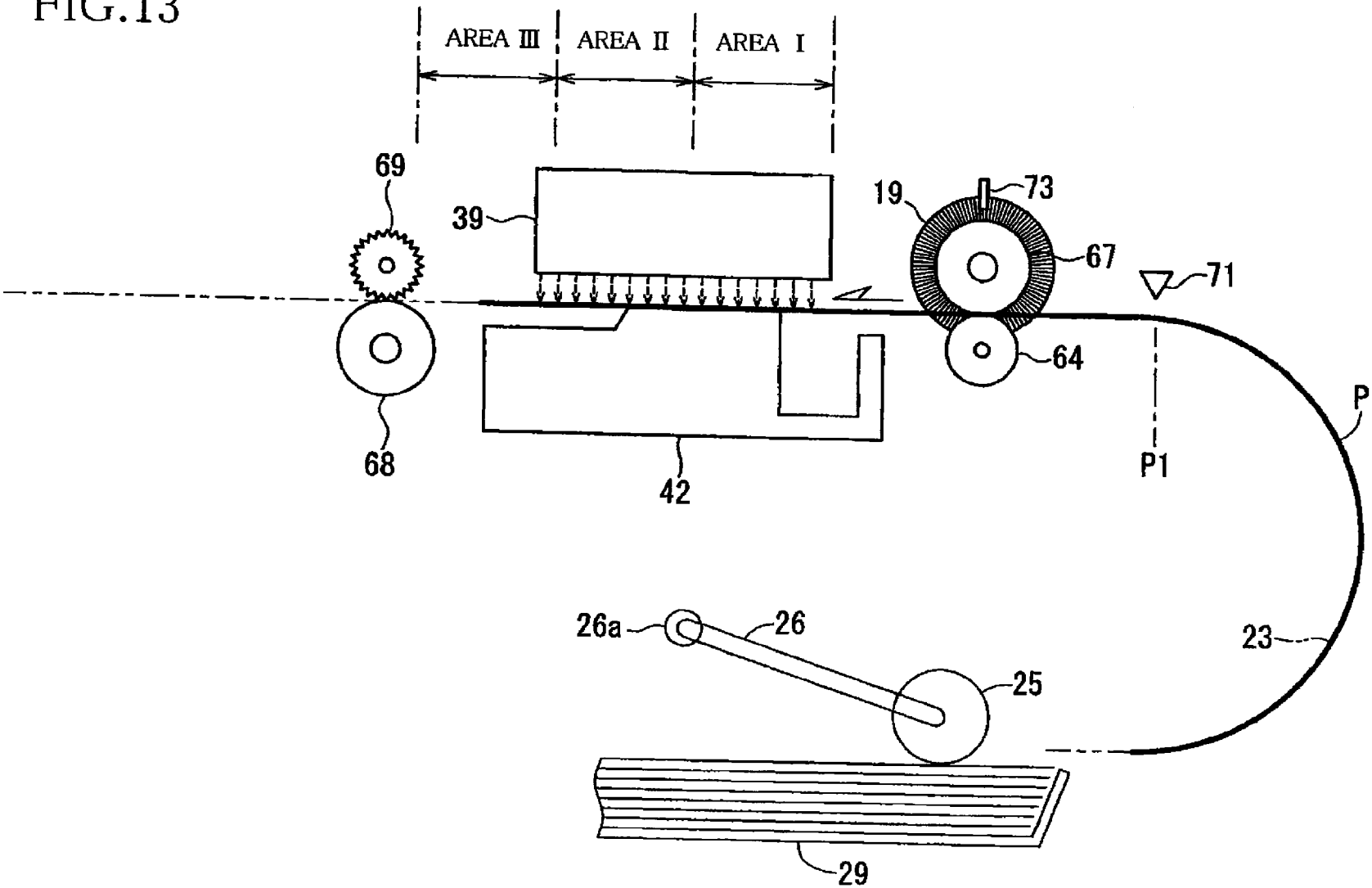
FIG. 13 is a view schematically showing a state in which the leading end of the recording sheet P is located within area III of the U-turn-shaped feed path.

FIGS. 11-13 schematically show the U-turn-shaped sheet feed path defined by the feed path definer 23. FIG. 11 shows a state in which the leading end of the recording sheet P is located within area I of the sheet feed path. FIG. 12 shows a state in which the leading end of the sheet P is located within area II of the sheet feed path. FIG. 13 shows a state in which the leading end of the sheet P is located within area III of the sheet feed path.

As shown in FIG. 11, at a stage immediately after initiation of the first successive rotational motions of the drive and driven rollers 67, 64, a front portion of the recording sheet P is in contact with the outer circumferential surface of the drive roller 67, while an intermediate portion of the sheet P is deflected and is slightly spaced apart from the wall of the curved portion of the feed path definer 23 by a small gap. Thus, at the stage as shown in FIG. 11 at which the leading end of the sheet P is located within the area I, the back tension applied to the sheet P is not so large although the sheet supply roller 25 is held in pressing contact with the sheet P. As shown in FIG. 12, when the leading end of the sheet P enters the area II, the sheet P is brought into contact at its intermediate portion with the wall of the curved portion of the feed path definer 23, without the above-described small gap. At this stage, the sheet P is pulled by the drive and driven rollers 67, 64 so as to be fed while the sheet supply roller 25 is held in pressing contact with the sheet P, and the friction acting between the sheet P and the curved portion of the feed path definer 23 is gradually increased. Therefore, the back tension applied to the sheet P is larger at this stage at which the leading end of the sheet P is located within the area II, than at the stage at which the leading end of the sheet P is located within the area I. As shown in FIG. 13, when the leading end of the sheet P enters the area III, the sheet P is separated from the sheet supply roller 25, and a portion of the sheet P that is in contact with the wall of the curved portion of the feed path definer 23 is gradually reduced, whereby the friction acting between the sheet P and the curved portion of the feed path definer 23 is gradually reduced. Therefore, the back tension applied to the sheet P is larger at this stage at which the leading end of the sheet P is located within the area III, than at the stage at which the leading end of the sheet P is located within the area II.

As is clear from the above description, as the leading end of the recording sheet P is moved from the area I to the area II, the back tension applied to the sheet P is gradually increased whereby the shortage in the actual amount of the feed movement of the sheet P is increased. Then, as the leading end of the recording sheet P is moved from the area II to the area III, the back tension applied to the sheet P is gradually reduced. Then, when the sheet P is separated from the carved portion of the feed path definer 23, the back tension is no longer applied to the sheet P, so that the sheet P is fed by the above-described desired distance as a result of each one of the first successive rotational motions, without the shortage in the actual amount of the feed movement of the sheet P.

As described above, during process of the feed movement of the recording sheet P, the back tension applied to the sheet P is gradually changed and accordingly the shortage in the actual amount of the feed movement of the sheet P is gradually changed. In the present embodiment, the sheet P is fed according to a manner that varies depending upon which one of the above-described three areas I, II and III the leading end of the sheet P is currently positioned in. Thus, by varying the manner for feeding the sheet P depending upon the current position of the leading end of the sheet P, it is possible to accurately and effectively compensate the shortage in the actual amount of the feed movement of the sheet P.

Figure 14:
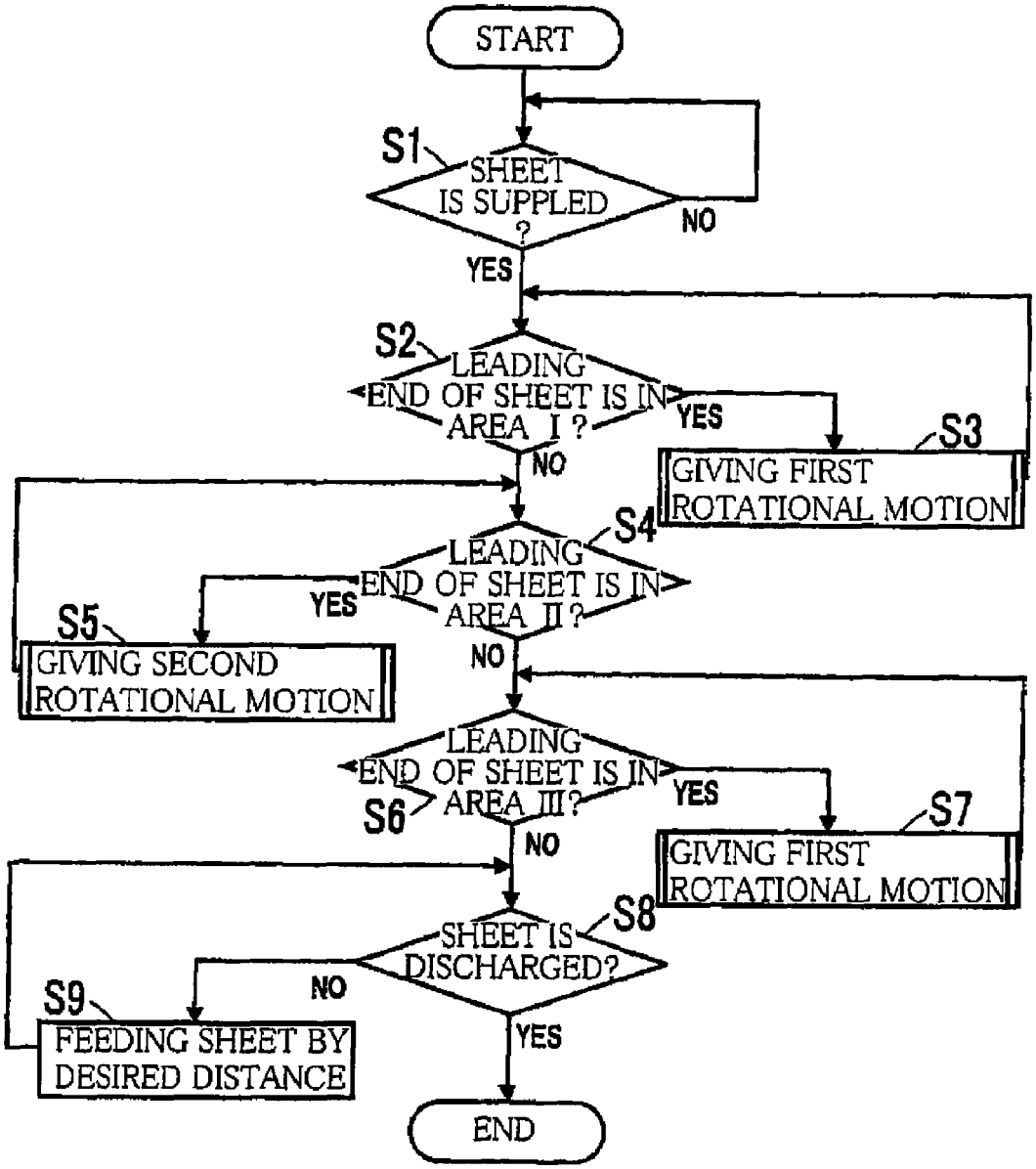
FIG. 14 is a flow chart showing a sheet-feed controlling routine program that is executed in the sheet feeder.
Figure 15:
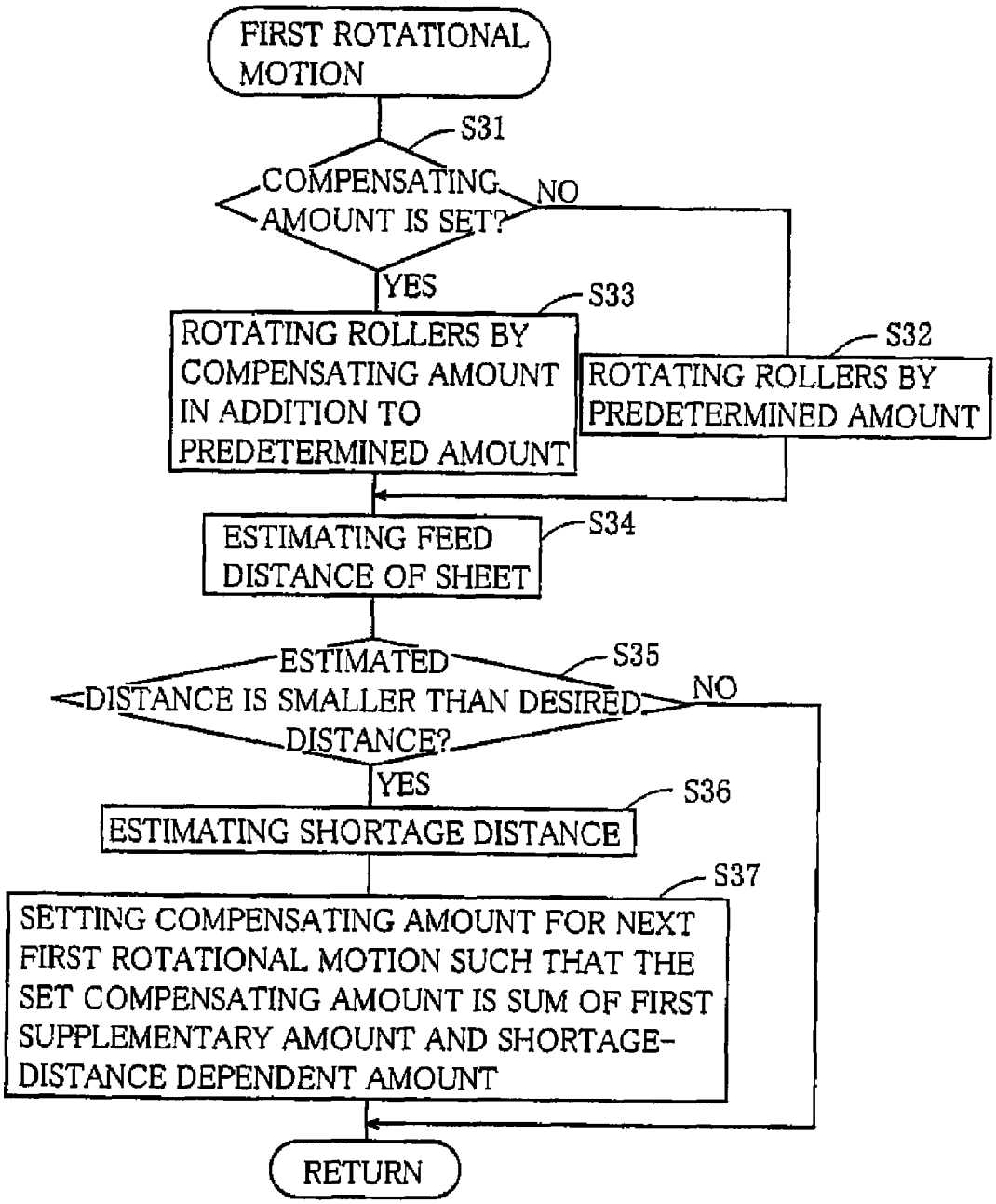
FIG. 15 is a flow chart showing a first-motion controlling routine program that is executed in implementation of each of steps S3 and S7 of the sheet-feed controlling routine program.
Figure 17:
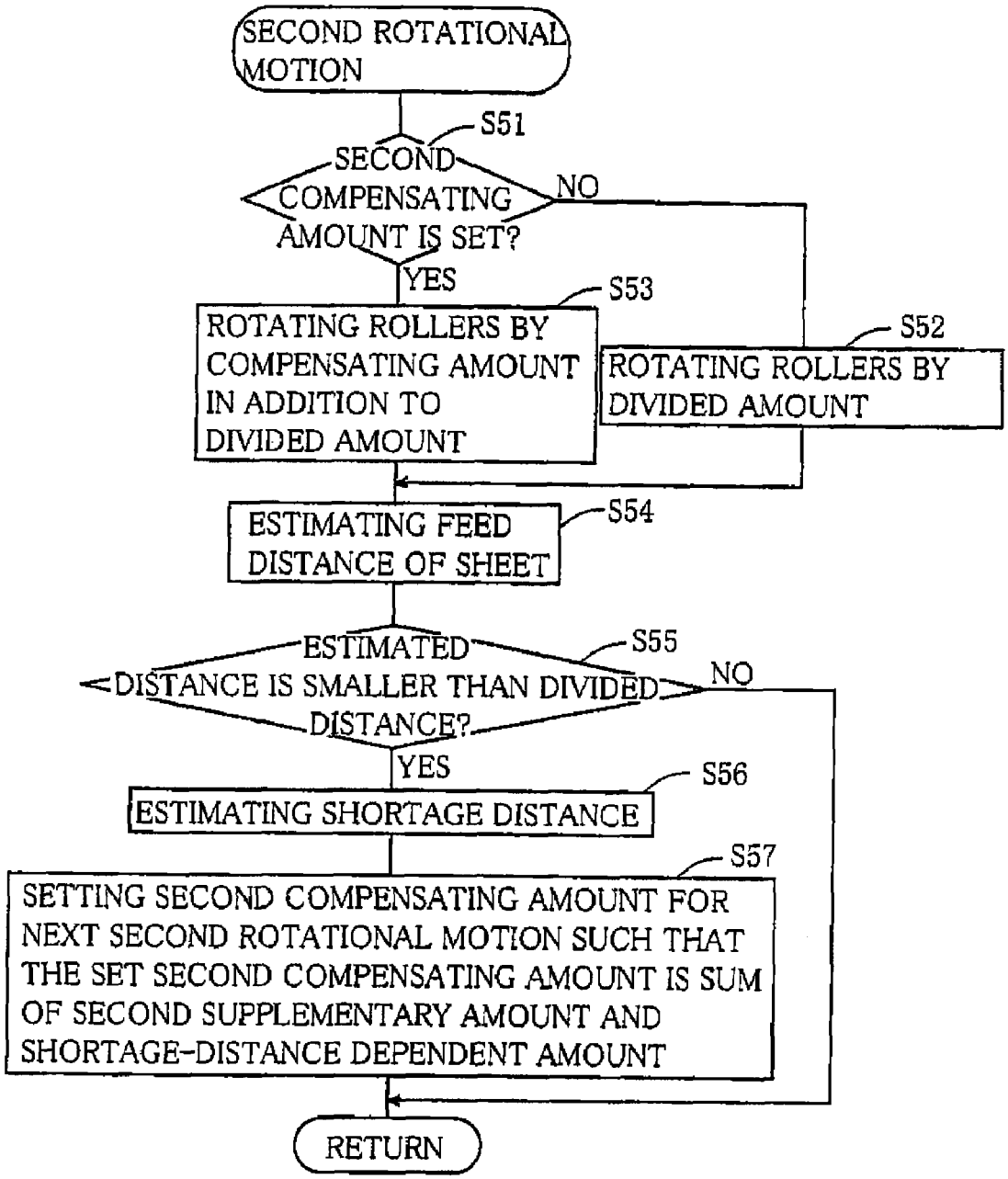
FIG. 17 is a flow chart showing the second-motion controlling routine program that is executed in implementation of step S5 of the sheet-feed controlling routine program.

Referring next to FIGS. 14-18, there will be next described a process of feeding the recording sheet P, according to the present embodiment of the invention. It is noted that the operations of the multifunction device 10 is carried out in accordance with commands, which are issued by the controller unit 100 based on controlling routine programs stored in the ROM 102. FIG. 14 is a flow chart showing a sheet-feed controlling routine program. FIG. 15 is a flow chart showing a first-motion controlling routine program that is executed in implementation of each of steps S3 and S7 of the sheet-feed controlling routine program. FIG. 17 is a flow chart showing a second-motion controlling routine program that is executed in implementation of step S5 of the sheet-feed controlling routine program. FIG. 16 is a supplementary-amount table 120 that is used in the first-motion controlling routine program of FIG. 15 and the second-motion controlling routine program of FIG. 17. FIG. 18 is a supplementary-amount table 125 that is used in the second-motion controlling routine program of FIG. 17.

As shown in FIG. 14, the sheet-feed controlling routine program is initiated with step S1 in which the controller unit 100 determines whether the recording sheet P has been supplied to the drive and driven rollers 67, 64. Specifically, step S1 is implemented by determining whether the number of steps of the LF motor 85 (see FIG. 9) (as counted from a moment of the detection of the sheet P by the register sensor 71 (see FIG. 10)) has reached the above-described predetermined number. If it is determined by the controller unit 100 in step S1 that the sheet P has not yet been supplied to the drive and driven rollers 67, 64, namely, if a negative decision (NO) is obtained in step S1, the control flow goes back to step S1. On the other hand, if it is determined by the controller unit 100 in step S1 that the sheet P has been supplied to the drive and driven rollers 67, 64, namely, if an affirmative decision (YES) is obtained in step S1, the control flow goes to step S2 that is implemented to determine whether the leading end of the sheet P is positioned within the area I. This determination in step S2 is made based on the feed distance of the sheet P that is estimated by the rotary encoder 83. For example, it is determined that the leading end of the sheet P is positioned within the area I, if the encoder amount detected by the optical sensor 73 (see FIG. 10) from initiation of the first successive rotational motions is in a range of 0 to 100.

If it is determined by the controller unit 100 in step S2 that the leading end of the sheet P is positioned within the area I, namely, if an affirmative decision (YES) is obtained in step S2, the control flow goes to step S3 as a rotational-motion causing step in which the controller unit 100 commands the drive and driven rollers 67, 64 to have the first rotational motion. Then, as the first rotational motion is done, the control flow goes back to step S2. That is, step S3 is repeatedly implemented until it is determined that the leading end of the sheet P is not positioned within the area I. In other words, the sheet P is intermittently fed by the repeated implementation of step S3 as long as the leading end of the sheet P is located within the area I.

On the other hand, if it is determined by the controller unit 100 in step S2 that the leading end of the sheet P is not positioned within the area I, namely, if a negative decision (NO) is obtained in step S2, the control flow goes to step S4 in which it is determined whether the leading end of the sheet P is positioned within the area II. Like the above-described determination in step S2, this determination in step S4 is made based on the feed distance of the sheet P that is estimated by the rotary encoder 83. For example, it is determined that the leading end of the sheet P is positioned within the area II, if the encoder amount detected by the optical sensor 73 from initiation of the first successive rotational motions is in a range of 101 to 200. If it is determined by the controller unit 100 in step S4 that the leading end of the sheet P is positioned within the area II, namely, if an affirmative decision (YES) is obtained in step S4, the control flow goes to step S5 as a rotational-motion causing step in which the controller unit 100 commands the drive and driven rollers 67, 64 to have the second rotational motion. Then, as the second rotational motion is done, the control flow goes back to step S4. That is, step S5 is repeatedly implemented until it is determined that the leading end of the sheet P is not positioned within the area II. In other words, the sheet P is intermittently fed by the repeated implementation of step S5 as long as the leading end of the sheet P is located within the area II.

If it is determined by the controller unit 100 in step S4 that the leading end of the sheet P is not positioned within the area II, namely, if a negative decision (NO) is obtained in step S4, the control flow goes to step S6 in which it is determined whether the leading end of the sheet P is positioned within the area III. Like the above-described determination in step S2, this determination in step S6 is made based on the feed distance of the sheet P that is estimated by the rotary encoder 83. For example, it is determined that the leading end of the sheet P is positioned within the area III, if the encoder amount detected by the optical sensor 73 from initiation of the first successive rotational motions is in a range of 201 to 300. If it is determined by the controller unit 100 in step S6 that the leading end of the sheet P is positioned within the area III, namely, if an affirmative decision (YES) is obtained in step S6, the control flow goes to step S7 as a rotational-motion causing step in which the controller unit 100 commands the drive and driven rollers 67, 64 to have the first rotational motion. Then, as the first rotational motion is done, the control flow goes back to step S6. That is, step S7 is repeatedly implemented until it is determined that the leading end of the sheet P is not positioned within the area III. In other words, the sheet P is intermittently fed by the repeated implementation of step S7 as long as the leading end of the sheet P is located within the area III. It is noted that the first rotational motion is given to the drive roller 67 in this step S7 as in the above-described step S3.

If it is determined by the controller unit 100 in step S6 that the leading end of the sheet P is not positioned within the area III, namely, if a negative decision (NO) is obtained in step S6, the control flow goes to step S8 in which it is determined whether the feed or convey movement of the sheet P is completed, namely, whether the sheet P has been discharged to the sheet exit tray 21 (see FIG. 2). For example, it is determined that the sheet P has been discharged to the sheet exit tray 21, if the encoder amount detected by the optical sensor 73 from initiation of the first successive rotational motions exceeds 700. If it is determined by the controller unit 100 in step S8 that the sheet P has not yet been discharged to the sheet exit tray 21, namely, if a negative decision (NO) is obtained in step S8, the control flow goes to step S9 in which the controller unit 100 commands the drive and driven rollers 67, 64 to have a rotational motion so as to cause the sheet P to be fed by the desired distance that corresponds to the amount of line feed. After implementation of step S9, the control flow goes back to step S8. That is, step S9 is repeatedly implemented until the leading end of the sheet P leaves out of the area III. In other words, the sheet P is intermittently fed by the repeated implementation of step S7 as long as the leading end of the sheet P is located within the area III. One cycle of execution of the sheet-feed controlling routine program of FIG. 14 is completed when it is determined by the controller unit 100 in step S8 that the sheet P has been discharged to the sheet exit tray 21.

As described above, as long as the leading end of the sheet P is positioned within the area I (see FIG. 11), step S3 is repeatedly implemented whereby the first successive rotational motions are given to the drive roller 67, for feeding the sheet P. Subsequently, as the leading end of the sheet P enters the area II (see FIG. 12), step S5 is repeatedly implemented whereby the second successive rotational motions are given to the drive roller 67, for feeding the sheet P. Then, as the leading end of the sheet P enters the area III (see FIG. 13), step S7 is repeatedly implemented whereby the first successive rotational motions are given to the drive roller 67, for feeding the sheet P. And then, as the leading end of the sheet P leaves the area III, step S9 is repeatedly implemented for feeding the sheet P. The controller unit 100 commands the recording head 30 to selectively eject the ink onto the sheet P while the sheet P is fed in the above-described manner, for thereby performing the recording operation.

Next, with reference to FIGS. 15 and 16, there will be described the first-motion controlling routine program that is executed in implementation of each of steps S3 and S7 of the sheet-feed controlling routine program of FIG. 14. The first-motion controlling routine program is executed when the affirmative decision (YES) is obtained in step S2, namely, when it is determined that the leading end of the sheet P is positioned within the area I. The first-motion controlling routine program is initiated with step S31 in which it is determined by the controller unit 100 whether a compensating amount (that will be described later) is set or stored in the RAM 103. If it is determined by the controller unit 100 in step S31 that the compensating amount is not set, namely, if a negative decision (NO) is obtained in step S31, it is determined that there is no shortage in an actual amount of the feed movement of the sheet P, and the control flow goes to step S32 in which the drive and driven rollers 67, 64 are commanded to be rotated by the predetermined amount, for thereby causing the sheet P to be fed by the desired distance that corresponds to the amount of line feed. On the other hand, if it is determined by the controller unit 100 in step S31 that the compensating amount is set, namely, if an affirmative decision (YES) is obtained in step S31, the control flow goes to step S33 that is implemented to read out the compensating amount stored in the RAM 103 and then to command the drive and driven rollers 67, 64 to be rotated by a compensated amount that is a sum of the predetermined amount and the compensating amount. Thus, owing to the compensating amount, the sheet P is fed by a distance larger where step S33 is implemented, than where step S32 is implemented.

Step S32 or step S33 is followed by step S34 as a feed-distance estimating step in which the controller unit 100 estimates the feed distance of the sheet P. Specifically, step S34 is implemented to estimate the distance by which the sheet P is actually fed as a result of the rotational motion given to the drive and driven rollers 67, 64 in step S32 or step S33, by measuring the actual amount of rotation of the drive roller 67 through the rotary encoder 83. Step S34 is followed by step S35 as a determining step in which the controller unit 100 determines whether the estimated distance (estimated in step S34) is shorter than the desired distance. Specifically, where steps S34 and S35 follow step S32, the determination in step S35 is made by comparing the actual amount of rotation of the drive roller 57 (that is detected by the rotary encoder 83) with the above-described predetermined amount. Where steps S34 and S35 follow step S33, the determination in step S35 is made by comparing the actual amount of rotation of the drive roller 57 (that is detected by the rotary encoder 83) with the above-described compensated amount as the sum of the predetermined amount and the compensating amount. If it is determined by the controller unit 100 in step S35 that the estimated distance is not shorter than the desired distance, namely, if a negative decision (NO) is obtained in step S35, the control flow goes back to step S2 of the sheet-feed controlling routine program as a main routine program (see FIG. 14). It is noted that, where the first-motion controlling routine program is executed as the implementation of step S7 as a result of the affirmative decision (YES) in step S6, the control flow goes back to step S6 after the negative decision (NO) in step S35.

On the other hand, if it is determined by the controller unit 100 in step S35 that the estimated distance is shorter than the desired distance, namely, if an affirmative decision (YES) is obtained in step S35, the control flow goes to step S36 as a shortage-distance estimating step that is implemented to estimate a shortage distance by which the estimated distance is smaller than the desired distance. Specifically, in this step S36, the controller unit 100 estimates the shortage distance, by subtracting the estimated distance (estimated in step S34) from the desired distance.

The above-described shortage distance is estimated based on the amount of rotation of the drive roller 67 that is measured or detected by the rotary encoder 83. Thus, the shortage distance is estimated without taking account of possible slipping of the drive and driven rollers 67, 64 relative to the sheet P. Therefore, it is not possible to accurately compensate the shortage in the actual amount of the feed movement of the sheet P, simply by commanding the drive and driven rollers 67, 64 to be rotated by a shortage-distance dependent amount (i.e., amount dependent on the estimated shortage distance) in addition to the above-described predetermined amount. In the multifunction device 10 constructed according to the present embodiment, the ROM 102 stores the supplementary-amount table 120 (see FIG. 16) that indicates various supplementary amounts each of which is to be included in the above-described compensating amount in a corresponding one of various cases. Each of the supplementary amounts is an amount that is predetermined based on a pre-estimated amount of slipping of the drive and driven rollers 67, 64 relative to the sheet P, which is caused by the back tension applied to the fed sheet P. The supplementary-amount table 120 is used in the first-motion controlling routine program of FIG. 15 and also in the second-motion controlling routine program of FIG. 17. In FIG. 16, "TYPE OF PAPER" indicates type of the sheet P, and "RESOLUTION" indicates resolution of the image that is to be recorded onto the sheet. The type of the sheet P and the resolution of the image are input through the operator's control panel 14 or external data supplier such as computer. "AREA I", "AREA II" and "AREA III" are areas shown in FIGS. 11-13.

For example, when a leading end of a glossy paper as the recording sheet P is positioned in the area I in a recording operation for recording an image of resolution of 1200 dpi, the controller unit 100 reads "4" (as the supplementary amount) out of the supplementary-amount table 120. When a leading end of an inkjet paper as the recording sheet P is positioned in the area III in a recording operation for recording an image of resolution of 2400 dpi, the controller unit 100 reads "2" (as the supplementary amount) out of the supplementary-amount table 120.

Step S36 is followed by step S37 as a controlling step in which the controller unit 100 sets the compensating amount for the following first rotational motion such that the set compensating amount is a sum of the first supplementary amount and the shortage-distance dependent amount. Specifically, in S37, the controller unit 100 calculates the compensating amount as the sum of the first supplementary amount (that is read out of the supplementary-amount table 120) and the shortage-distance dependent amount (that is obtained based on the shortage distance estimated in step S36), and stores the calculated compensating amount in the RAM 103, so that the drive and driven rollers 67, 64 are rotated by the compensated amount as the sum of the predetermined amount and the compensating amount in the following first rotational motion. Where the compensating amount is thus stored in the RAM 103, the affirmative decision (YES) is obtained in step S31, whereby step S33 is implemented to rotate the drive and driven rollers 67, 64 by the compensated amount as the sum of the predetermined amount and the compensating amount. Where the negative decision (NO) is obtained in step S35, the compensating amount is not stored in the RAM 103, whereby the negative decision (NO) is obtained in step S31.

As describe above, step S34 as the feed-distance estimating step is implemented to measure an actual amount of rotation of the drive roller 67 in each one of the first successive rotational motions, for estimating a distance by which the recording sheet P is actually fed as a result of the each one of the first successive rotational motions. Then, step S35 as the determining step is implemented to determine whether the estimated distance is smaller than the desired distance. Step S37 as the controlling step is implemented to control the drive and driven rollers 67, 64 in a following one of the first successive rotational motions that follows the each one of the first successive rotational motions, and to command the drive and driven rollers 67, 46 to be rotated by the compensated amount (as the sum of the predetermined amount and the compensating amount) in the following first rotational motion when it is determined in step S35 that it is determined that the estimated distance is smaller than the desired distance.

The above-described predetermined amount, first supplementary amount, shortage-distance dependent amount, and compensating amount (as the sum of the first supplementary amount and shortage-distance dependent amount) are all represented by the above-described encoder amount that is detected by the optical sensor 73 (see FIG. 10). For example, where "100" is set as the predetermined amount while "5" is stored as the compensating amount in the RAM 103, the LF motor 85 (for rotating the drive roller 67) is controlled by the controller unit 100 such that the encoder amount is detected by the optical sensor 73 to be "105" in the following first rotational motion. In this instance, by using the supplementary-amount table 120, the controller unit 100 changes the first supplementary amount, depending upon the type of the sheet P that is to be supplied to the drive roller 67 and also depending upon an ordinal number of the following first rotational motion as counted from initiation of the first successive rotational motions. In the present embodiment, the change of the first supplementary amount depending upon the ordinal number is made depending upon which one of the above-described areas I-III the leading end of the sheet P is currently positioned in. That is, while the leading end of the sheet P is positioned in a same one of the areas I-III, the same first supplementary amount is used. When the area in which the leading end of the sheet P is changed, the first supplementary amount is changed.

Next, with reference to FIGS. 16-18, there will be described the second-motion controlling routine program that is executed in implementation of step S5 of the sheet-feed controlling routine program of FIG. 14. The drive and driven rollers 67, 64 are rotated by the divided amount in each one of the second successive rotational motions, for thereby causing the sheet P nipped between the rollers 67, 64, to be fed along the sheet feed path by the divided distance. The divided amount is an amount into which the above-described predetermined amount is divided by a predetermined number "n". In the following description, there will be described a case where the predetermined number "n" is "two" by way of example. However, the predetermined number "n" may be any number that is not smaller than "two".

The second-motion controlling routine program is executed when the affirmative decision (YES) is obtained in step S4, namely, when it is determined that the leading end of the sheet P is positioned within the area II. The second-motion controlling routine program is initiated with step S51 in which it is determined by the controller unit 100 whether a second (finely) compensating amount is set or stored in the RAM 103. This second compensating amount is set in substantially the same manner as the above-described compensating amount that in set in the above-described step S37. If it is determined by the controller unit 100 in step S51 that the second compensating amount is not set, namely, if a negative decision (NO) is obtained in step S51, it is determined that there is no shortage in an actual amount of the feed movement of the sheet P, and the control flow goes to step S52 in which the drive and driven rollers 67, 64 are commanded to be rotated by the divided amount, for thereby causing the sheet P to be fed by the divided distance. In the present embodiment, since the above-described predetermined number "n" is "two", the divided distance corresponds to a half of the amount of line feed. On the other hand, if it is determined by the controller unit 100 in step S51 that the second compensating amount is set, namely, if an affirmative decision (YES) is obtained in step S51, the control flow goes to step S53 that is implemented to read out the second compensating amount stored in the RAM 103 and then to command the drive and driven rollers 67, 64 to be rotated by a second (finely) compensated amount that is a sum of the divided amount and the second compensating amount. Thus, owing to the second compensating amount, the sheet P is fed by a distance larger where step S53 is implemented, than where step S52 is implemented.

Step S52 or step S53 is followed by step S54 as a feed-distance estimating step in which the controller unit 100 estimates the feed distance of the sheet P. Specifically, step S54 is implemented to estimate the distance by which the sheet P is actually fed as a result of the rotational motion given to the drive and driven rollers 67, 64 in step S52 or step S53, by measuring the actual amount of rotation of the drive roller 67 through the rotary encoder 83. Step S54 is followed by step S55 as a determining step in which the controller unit 100 determines whether the estimated distance (estimated in step S54) is shorter than the divided distance. Specifically, where steps S54 and S55 follow step S52, the determination in step S55 is made by comparing the actual amount of rotation of the drive roller 57 (that is detected by the rotary encoder 83) with the above-described divided amount. Where steps S54 and S55 follow step S53, the determination in step S55 is made by comparing the actual amount of rotation of the drive roller 57 (that is detected by the rotary encoder 83) with the above-described second compensated amount as the sum of the divided amount and the second compensating amount. If it is determined by the controller unit 100 in step S55 that the estimated distance is not shorter than the divided distance, namely, if a negative decision (NO) is obtained in step S55, the control flow goes back to step S4 of the sheet-feed controlling routine program as the main routine program (see FIG. 14).

On the other hand, if it is determined by the controller unit 100 in step S55 that the estimated distance is shorter than the divided distance, namely, if an affirmative decision (YES) is obtained in step S55, the control flow goes to step S56 as a shortage-distance estimating step that is implemented to estimate a shortage distance by which the estimated distance is smaller than the divided distance. Specifically, in this step S56, the controller unit 100 estimates the shortage distance, by subtracting the estimated distance (estimated in step S54) from the divided distance.

In the multifunction device 10 constructed according to the present embodiment, the ROM 102 stores the supplementary-amount table 125 (see FIG. 18) that indicates various supplementary amounts each of which is to be included in the above-described second compensating amount in a corresponding one of various cases. Each of the supplementary amounts is an amount that is predetermined based on a pre-estimated amount of slipping of the drive and driven rollers 67, 64 relative to the sheet P, which is caused by the back tension applied to the fed sheet P. The supplementary-amount table 125 is not used in the first-motion controlling routine program of FIG. 15 and is used in the second-motion controlling routine program of FIG. 17.

In execution of the second-motion controlling routine program in implementation of step S5 of the sheet-feed controlling routine program, the supplementary-amount tables 120, 125 are both used. As in execution of the first-motion controlling routine program, the controller unit 100 reads, out of the supplementary-amount table 120, the supplementary amount (hereinafter referred to as "supplementary amount $\alpha$") that corresponds to the current case. At the same time, the controller unit 100 reads, out of the supplementary-amount table 125, the supplementary amount (hereinafter referred to as "supplementary amount $\beta$") that corresponds to the current case. A second (finely) supplementary amount that is to be added, together with the shortage-distance dependent amount, to the divided amount is the supplementary amount $\alpha$ divided by two plus the divided amount $\beta$ ($\alpha/2+\beta$). For example, when a leading end of a glossy paper as the recording sheet P is positioned in the area II in a recording operation for recording an image of resolution of 1200 dpi the controller unit 100 reads "4" (as the supplementary amount $\alpha$) out of the supplementary-amount table 120, and also reads "1" (as the supplementary amount $\beta$) out of the supplementary-amount table 125. In this case, the second supplementary amount is "3" (=4/2+1).

Step S56 is followed by step S57 as a controlling step in which the controller unit 100 sets the second compensating amount for the following second rotational motion such that the set second compensating amount is a sum of the second supplementary amount and the shortage-distance dependent amount. Specifically, in S57, the controller unit 100 calculates the second compensating amount as the sum of the second supplementary amount (that is obtained from the supplementary-amount tables 120, 125) and the shortage-distance dependent amount (that is obtained based on the shortage distance estimated in step S56), and stores the calculated second compensating amount in the RAM 103, so that the drive and driven rollers 67, 64 are rotated by the second compensated amount as the sum of the divided amount and the second compensating amount in the following second rotational motion. Where the second compensating amount is thus stored in the RAM 103, the affirmative decision (YES) is obtained in step S51, whereby step S53 is implemented to rotate the drive and driven rollers 67, 64 by the second compensated amount as the sum of the divided amount and the second compensating amount. Where the negative decision (NO) is obtained in step S55, the second compensating amount is not stored in the RAM 103, whereby the negative decision (NO) is obtained in step S51.

As describe above, step S54 as the feed-distance estimating step is implemented to measure an actual amount of rotation of the drive roller 67 in each one of the second successive rotational motions, for estimating a distance by which the recording sheet P is actually fed as a result of the each one of the second successive rotational motions. Then, step S55 as the determining step is implemented to determine whether the estimated distance is smaller than the divided distance. Step S57 as the controlling step is implemented to control the drive and driven rollers 67, 64 in a following one of the second successive rotational motions that follows the each one of the second successive rotational motions, and to command the drive and driven rollers 67, 46 to be rotated by the second compensated amount (as the sum of the divided amount and the second compensating amount) in the following second rotational motion when it is determined in step S55 that it is determined that the estimated distance is smaller than the divided distance.

The above-described divided amount, second supplementary amount, shortage-distance dependent amount, and second compensating amount (as the sum of the second supplementary amount and shortage-distance dependent amount) are all represented by the above-described encoder amount that is detected by the optical sensor 73 (see FIG. 10). For example, where "50" (that is a half of "100" as the predetermined amount) is set as the divided amount while "3" is stored as the second compensating amount in the RAM 103, the LF motor 85 (for rotating the drive roller 67) is controlled by the controller unit 100 such that the encoder amount is detected by the optical sensor 73 to be "53" in the following second rotational motion. In this instance, by using the supplementary-amount tables 120, 125, the controller unit 100 changes the second supplementary amount, depending upon the type of the sheet P that is to be supplied to the drive roller 67.

As described above, during the feed movement of the recording sheet P by rotation of the drive and driven rollers 67, 64, a friction acts between the sheet P and the feed path definer 23. This friction, which acts as a back tension applied to the sheet P, is relatively large immediately after initiation of the feed movement of the sheet P by the drive and driven rollers 67, 64. The friction is gradually reduced as a portion of the sheet P that is in contact with the feed path definer 23 is gradually reduced. As described above, the sheet supply tray 29 accommodating the sheet P has the first and second tray portions 91, 92. Where the sheet P accommodated in the second tray portion 92 is supplied toward the feed path definer 23, the sheet supply roller 25 is pivoted upwardly (as indicated by arrow 18 of FIG. 10) by a pressing force applied from the second tray portion 92 to the sheet supply roller 25. Therefore, a pressing force, by which the sheet supply roller 25 is in pressing contact with the sheet P, is larger where the sheet supply roller 25 is in contact with the sheet P accommodated in the second tray portion 92, than where the sheet supply roller 25 is in contact with the sheet P accommodated in the first tray portion 91. As the fed sheet P is separated from the sheet supply roller 25, the sheet supply roller 25 does not apply the back tension to the sheet P.

In the printer unit 20, there is a case of slipping of the drive roller 67 relative to the recording sheet P, which is caused due to the back tension applied to the sheet P. This slipping cannot be detected even where rotation of the drive roller 67 is monitored by a sensor such as the rotary encoder 83. The supplementary amounts of the supplementary-amount tables 120, 125 are amounts each of which is predetermined based on a pre-estimated amount of the slipping of the drive roller 67. It is therefore possible to compensate shortage in an actual amount of the feed movement of the sheet P, which shortage is caused due to the slipping that is not detected by the sensor. Further, the supplementary amounts stored in the supplementary-amount tables 120, 125 are suitably determined with account being taken of amount of the back tension applied to the sheet P from the feed path definer 23 and also amount of the back tension applied to the sheet P from the sheet supply roller 25, thereby making it possible to accurately compensate the shortage in the actual amount of the feed movement of the sheet P, which shortage is caused due to presence of the feed path definer 23 and sheet supply roller 25.

As the recording sheet P that is to be supplied to the drive and driven rollers 67, 64, there are various types of papers such as standard paper, glossy paper and inkjet paper, as described above. The back tension applied to the sheet P during the first and second rotational motions varies depending upon the type of the sheet P, since the various types of papers have different thickness values and surface conditions. However, in the present embodiment, by using the supplementary-amount tables 120, 125, the first supplementary amount and the second (finely) supplementary amount are changed depending upon the type of the sheet P, thereby making it possible to reliably compensate the shortage in the actual amount of the feed movement of the sheet P, irrespective of the type of the sheet P.

The back tension applied to the recording sheet P during the first and second rotational motions is changed depending upon stage of the feed movement of the sheet P, so that the shortage distance is changed depending upon the stage of the feed movement. However, in the present embodiment, by using the supplementary-amount tables 120, 125, the first supplementary amount and the second (finely) supplementary amount are changed depending upon the area in which the leading end of the sheet P is currently positioned, thereby making it possible to accurately compensate the shortage in the actual amount of the feed movement of the sheet P.

The feed movement of the recording sheet P is temporarily stopped between each one of the first successive rotational motions and a following one of the first successive rotational motions (that follows the each of the first successive rotational motions). During each temporary stop of the feed movement of the sheet P, the recording head 39 is moved in the main scanning direction (substantially perpendicular to the sheet feed direction), whereby a portion of the desired image that corresponds to the amount of line feed is recorded on the sheet P. Thus, the movement of the recording head 39 with ejection of the ink droplets and the feed movement of the sheet P by the desired distance are alternately repeated whereby the image or script is continuously formed on an entirety of the sheet P. Since the image or script is thus recorded on the sheet P, the resolution of the image in a sub-scanning direction (that is perpendicular to the main scanning direction) is changed by changing the desired distance that corresponds to the amount of line feed. In the present embodiment, by using the supplementary-amount table 120, the first supplementary amount is changed depending upon the resolution of the image, so that it is possible to effectively avoid a so-called banding, i.e., reduction in quality of the image, which is caused by the shortage in the actual amount of the feed movement of the sheet P.

Further, in the present embodiment, the shortage in the actual amount of the feed movement of the sheet P is compensated in each first or second rotational motion in case of determination that there is a shortage in the actual amount of the feed movement of the sheet P in a preceding first or second rotational motion that precedes the each first or second rotational motion. Therefore, the shortage can be compensated at a suitable timing. Further, it is possible to prevent the sheet P from being excessively fed, since the drive and driven rollers 67, 64 are rotated by the compensated amount in each first or second rotational motion, only in case of determination that there is a shortage in the preceding first or second rotational motion.

Further, in the present embodiment, the second successive rotational motions are given to the drive and driven rollers 67, 64 while the leading end of the recording sheet P is positioned within the area II. In each one of the second successive rotational motions, the rollers 67, 64 are rotated by the divided amount, for thereby causing the sheet P to be fed by the divided distance. By repeating the second rotational motion the predetermined number "n" of times, the rollers 67, 64 are rotated by the above-described predetermined amount whereby the sheet P is fed by the above-described desired distance. It can be considered that each first rotational motion is completed by repeating the second rotational motion the predetermined number "n" of times. That is, while the leading end of the sheet P is positioned within the area II, namely, while the affirmative decision (YES) is obtained in step S4 of the above-described sheet-feed controlling routine program, each first rotational motion is executed by repeating the second rotational motion the predetermined number "n" of times. When it is determined by the controller unit 100 that the feed distance of the sheet P estimated by the rotary encoder 83 is smaller than the divided distance, the rotation of the drive roller 67 is controlled such that the drive and driven rollers 67, 64 are rotated by the second compensated amount for compensating the shortage in the feed distance. It is therefore possible to compensate the shortage at suitable timing and also to prevent the sheet P from being excessively fed. Further, since the determination as to the shortage in the feed distance is made in each one of the second successive rotational motions, the shortage can be finely compensated. Thus, it is possible to minimize a deviation of the actual feed distance from the desired distance after each line feed, thereby effectively avoid a banding.

While the presently preferred embodiment of the invention has been described above in detail, it is to be understood that the invention is not limited to the details of the illustrated embodiment, but may be otherwise embodied without departing from the spirit of the invention.

In the above-described embodiment, the supplementary amount is an amount that is predetermined based on a pre-estimated amount of slipping of the drive and driven rollers 67, 64 relative to the recording sheet P, which is caused by the back tension applied to the fed sheet P. However, the supplementary amount is not particularly limited. For example, the shortage distance may be pre-estimated rather than being estimated through the detection or measurement of rotation of the drive roller 67 that is made by the rotary encoder 83, so that the pre-estimated shortage distance as well as the pre-estimated slipping amount can be included in the supplementary amount. In such a case, the estimation of the shortage distance through the rotary encoder 83 is not necessary.

In the above-described embodiment, the second successive rotational motions are executed while the leading end of the recording sheet P is positioned within the area II. However, the second successive rotational motions may be executed while the leading end of the sheet P is positioned within the other area. That is, the areas assigned for the first and second successive rotational motions may be changed. For example, the second successive rotational motions may be executed while the leading end of the sheet P is positioned within any one of the areas I-III. In this modified arrangement, it is preferable that the second supplementary amount is changed depending upon an ordinal number of the following second rotational motion as counted from initiation of the second successive rotational motions. The change of the second supplementary amount depending upon the ordinal number may be made depending upon which one of the above-described areas I-III the leading end of the sheet P is currently positioned in. That is, while the leading end of the sheet P is positioned in a same one of the areas I-III, the same second supplementary amount is used. When the area in which the leading end of the sheet P is changed, the second supplementary amount is changed.

In the above-described embodiment, the sheet P is fed according to a manner that varies depending upon which one of the above-described three areas I, II and III the leading end of the sheet P is currently positioned in. However, the number of the areas does not necessarily have to be three but may be smaller or larger than three. Further, the first or second successive rotational motions may be executed in all of the areas. Further, the sheet P may be fed according to a manner that does not vary depending upon which one of the areas the leading end of the sheet P is currently positioned in.

What is claimed is:

1. A sheet feeder comprising:

a pair of feed rollers operable to have a plurality of successive rotational motions, so as to be rotated by a predetermined amount in each one of the successive rotational motions, for thereby causing a sheet nipped between said pair of feed rollers, to be fed along a feed path by a desired distance as a result of said each one of the successive rotational motions;

a back-tension applier disposed in the feed path, and configured to apply a back tension to the sheet that is fed along the feed path;

a rotary encoder disposed on one of the pair of feed rollers;

a sheet position sensor disposed in the feed path; and a motion controller configured to estimate an amount of slipping of the feed rollers relative to the sheet, to control the successive rotational motions of said feed rollers, and to command said feed rollers to be rotated by a compensated amount that includes a supplementary amount in addition to said predetermined amount, in each of at least one of the successive rotational motions, wherein said supplementary amount included in said compensated amount is an amount that is predetermined based on the estimated amount of slipping of said feed rollers relative to the sheet to which the back tension is applied.

2. The sheet feeder according to claim 1, wherein said back-tension applier includes a feed path definer having a curved portion and defining at least a curved part of the feed path, and wherein said feed rollers are disposed on a downstream side of said feed path definer in a direction in which the sheet is to be fed along the feed path.

3. The sheet feeder according to claim 1, wherein said back-tension applier includes a supply roller configured to be held in pressing contact with the sheet and operable to supply the sheet toward said feed rollers.

4. The sheet feeder according to claim 1, wherein said supplementary amount included in said compensated amount is changed, by said motion controller, depending upon type of the sheet.

5. The sheet feeder according to claim 1, further comprising an image recorder operable to record an image onto the sheet, wherein said predetermined amount of rotation of said feed rollers in each one of the successive rotational motions is changed depending upon a desired resolution of the image that is to be recorded onto the sheet, and wherein said supplementary amount included in said compensated amount is changed, by said motion controller, depending upon the desired resolution of the image.

6. The sheet feeder according to claim 1, further comprising:

a feed distance estimator operable to measure an actual amount of rotation of said feed rollers in each one of the successive rotational motions, for estimating a distance by which the sheet is actually fed as a result of said each one of the successive rotational motions; and a determiner configured to determine whether the estimated distance is smaller than said desired distance, wherein said motion controller is configured to control said feed rollers in a following one of the successive rotational motions that follows said each one of the successive rotational motions, and to command said feed rollers to be rotated by said compensated amount in the following rotational motion when it is determined that said estimated distance is smaller than said desired distance.

7. The sheet feeder according to claim 6, further comprising a shortage distance estimator operable to estimate a shortage distance by which said estimated distance is smaller than said desired distance, wherein said compensated amount includes, in addition to said predetermined amount and said supplementary amount, a shortage-distance dependent amount that is dependent on the estimated shortage distance.

8. The sheet feeder according to claim 1, wherein each of at least one of said plurality of successive rotational motions as a plurality of standard successive rotational motions is completed by a plurality of fine successive rotational motions, such that said feed rollers are rotated by a divided amount into which said predetermined amount is divided by a predetermined number, in each one of the fine successive rotational motions, for thereby causing the nipped sheet to be fed along said feed path by a divided distance into which said desired distance is divided by said predetermined number, as a result of said each one of the fine successive rotational motions, said sheet feeder further comprising:

a feed distance estimator operable to measure an actual amount of rotation of said feed rollers in each one of the fine successive rotational motions, for estimating a distance by which the sheet is actually fed as a result of said each one of the fine successive rotational motions; and a determiner configured to determine whether the estimated distance is smaller than said divided distance, wherein said motion controller is configured to control said feed rollers in a following one of the fine successive rotational motions that follows said each one of the fine successive rotational motions, and to command said feed rollers to be rotated by a finely compensated amount that includes a finely supplementary amount in addition to said divided amount, in the following rotational motion when it is determined that said estimated distance is smaller than said divided distance.

9. The sheet feeder according to claim 8, further comprising a shortage distance estimator operable to estimate a shortage distance by which said estimated distance is smaller than said divided distance, wherein said finely compensated amount includes, in addition to said divided amount and said finely supplementary amount, a shortage-distance dependent amount that is dependent on the estimated shortage distance.

10. The sheet feeder according to claim 8, wherein said finely supplementary amount included in said finely compensated amount is changed, by said motion controller, depending upon an ordinal number of said following rotational motion as counted from initiation of the fine successive rotational motions.

11. The sheet feeder according to claim 8, further comprising an image recorder operable to perform a recording operation for recording an image onto the sheet, wherein said image recorder includes a recording head that is moved, during the recording operation, in a direction substantially perpendicular to a direction in which the sheet is fed along the feed path, after each of said plurality of standard successive rotational motions of said feed rollers that causes the sheet to be fed by said desired distance corresponding to an amount of line feed.

12. The sheet feeder according to claim 1, further comprising:

a feed distance estimator operable to measure an actual amount of rotation of said feed rollers in each one of the successive rotational motions, for estimating a distance by which the sheet is actually fed as a result of said each one of the successive rotational motions; and a determiner configured to determine whether the estimated distance is smaller than said desired distance, wherein said motion controller is configured to control said feed rollers in a following one of the successive rotational motions that follows said each one of the successive rotational motions, such that said controller commands said feed rollers to be rotated by said compensated amount in the following rotational motion when it is determined that said estimated distance is smaller than said desired distance, and such that said controller commands said feed rollers to be rotated by said predetermined amount in the following rotational motion when it is determined that said estimated distance is not smaller than said desired distance.

13. A process of feeding a sheet by using a sheet feeder including (i) a pair of feed rollers operable to have a plurality of successive rotational motions, so as to be rotated by a predetermined amount in each one of the successive rotational motions, for thereby causing a sheet nipped between said pair of feed rollers, to be fed along a feed path by a desired distance as a result of said each one of the successive rotational motions, and (ii) a back-tension applier disposed in the feed path, and configured to apply a back tension to the sheet that is fed along the feed path, said process comprising:

a rotational-motion causing step of causing said pair of feed rollers to have each one of the plurality of successive rotational motions, so as to be rotated by said predetermined amount in said each one of the successive rotational motions, for thereby causing the nipped sheet to be fed along the feed path by said desired distance as a result of said each one of the successive rotational motions;

a detecting step of detecting a rotational motion of the feed rollers;

a sensing step of sensing a position of the sheet;

an estimating step of estimating an amount of slipping of the feed rollers relative to the sheet;

a controlling step of controlling the successive rotational motions of said feed rollers, and commanding said feed rollers to be rotated by said compensated amount that includes said supplementary amount in addition to said predetermined amount, in each of said at least one of the successive rotational motions, wherein said supplementary amount included in said compensated amount is an amount that is predetermined based on the estimated amount of slipping of said feed rollers relative to the sheet to which the back tension is applied.

14. The process according to claim 13, wherein said back-tension applier includes a feed path definer having a curved portion and defining at least a curved part of the feed path, and wherein said feed rollers are disposed on a downstream side of said feed path definer as viewed in a direction in which the sheet is to be fed along the feed path.

15. The process according to claim 13, wherein said back-tension applier includes a supply roller configured to be held in pressing contact with the sheet and operable to supply the sheet toward said feed rollers.

16. The process according to claim 13, further comprising:

a feed-distance estimating step of measuring an actual amount of rotation of said feed rollers in each one of the successive rotational motions, for estimating a distance by which the sheet is actually fed as a result of said each one of the successive rotational motions; and a determining step of determining whether the estimated distance is smaller than said desired distance, wherein said feed-distance estimating step and said determining step are implemented between implementations of said rotational-motion causing step and said controlling step, and wherein said controlling step is implemented to control said feed rollers in a following one of the successive rotational motions that follows said each one of the successive rotational motions, and to command said feed rollers to be rotated by said compensated amount in the following rotational motion when it is determined that said estimated distance is smaller than said desired distance.

17. The process according to claim 16, further comprising a shortage-distance estimating step of estimating a shortage distance by which said estimated distance is smaller than said desired distance, wherein said shortage-distance estimating step is implemented between implementations of said determining step and said controlling step, and wherein said compensated amount includes, in addition to said predetermined amount and said supplementary amount, a shortage-distance dependent amount that is dependent on the estimated shortage distance.

18. The process according to claim 13, wherein said rotational-motion causing step is implemented by completing each of at least one of said plurality of successive rotational motions as a plurality of standard successive rotational motions, by a plurality of fine successive rotational motions, such that said feed rollers are rotated by a divided amount into which said predetermined amount is divided by a predetermined number, in said each one of the fine successive rotational motions, for thereby causing the nipped sheet to be fed along said feed path by a divided distance into which said desired distance is divided by said predetermined number, as a result of said each one of the fine successive rotational motions, said process further comprising:

a feed-distance estimating step of measuring an actual amount of rotation of said feed rollers in each one of the fine successive rotational motions, for estimating a distance by which the sheet is actually fed as a result of said each one of the fine successive rotational motions; and a determining step of determining whether the estimated distance is smaller than said divided distance, wherein said feed-distance estimating step and said determining step are implemented between implementations of said rotational-motion causing step and said controlling step, and wherein said controlling step is implemented to control said feed rollers in a following one of the fine successive rotational motions that follows said each one of the fine successive rotational motions, and to command said feed rollers to be rotated by a finely compensated amount that includes a finely supplementary amount in addition to said divided amount, in the following rotational motion when it is determined that said estimated distance is smaller than said divided distance.

19. The process according to claim 18, further comprising a shortage-distance estimating step of estimating a shortage distance by which said estimated distance is smaller than said divided distance, wherein said shortage-distance estimating step is implemented between implementations of said determining step and said controlling step, and wherein said compensating amount includes, in addition to said divided amount and said finely supplementary amount, a shortage-distance dependent amount that is dependent on the estimated shortage distance.

20. The process according to claim 13, further comprising:

a feed-distance estimating step of measuring an actual amount of rotation of said feed rollers in each one of the successive rotational motions, for estimating a distance by which the sheet is actually fed as a result of said each one of the successive rotational motions; and a determining step of determining whether the estimated distance is smaller than said desired distance, wherein said feed-distance estimating step and said determining step are implemented between implementations of said rotational-motion causing step and said controlling step, and wherein said controlling step is implemented to control said feed rollers in a following one of the successive rotational motions that follows said each one of the successive rotational motions, such that said feed rollers are rotated by said compensated amount in the following rotational motion when it is determined that said estimated distance is smaller than said desired distance, and such that said feed rollers are rotated by said predetermined amount in the following rotational motion when it is determined that said estimated distance is not smaller than said desired distance.

21. A sheet feeder comprising:

a pair of feed rollers operable to have a plurality of successive rotational motions, so as to be rotated by a predetermined amount in each one of the successive rotational motions, for thereby causing a sheet nipped between said pair of feed rollers, to be fed along a feed path by a desired distance as a result of said each one of the successive rotational motions;

a back-tension applier disposed in the feed path, and configured to apply a back tension to the sheet that is fed along the feed path;

a rotary encoder disposed on one of the pair of feed rollers;

a sheet position sensor disposed in the feed path; and a motion controller configured to estimate an amount of slipping of the feed rollers relative to the sheet, to control the successive rotational motions of said feed rollers, and to command said feed rollers to be rotated by a compensated amount that includes a supplementary amount in addition to said predetermined amount, in each of at least one of the successive rotational motions, wherein said supplementary amount included in said compensated amount is changed, by said motion controller, depending upon an ordinal number of said following rotational motion as counted from initiation of the successive rotational motions.

* * * * *